US010488777B2

(12) United States Patent
Terauchi et al.

(10) Patent No.: US 10,488,777 B2
(45) Date of Patent: Nov. 26, 2019

(54) TONER

(71) Applicant: CANON KABUSHIKI KAISHA, Tokyo (JP)

(72) Inventors: Kazuo Terauchi, Numazu (JP); Yojiro Hotta, Mishima (JP); Koji Nishikawa, Susono (JP); Masami Fujimoto, Suntou-gun (JP); Takaaki Furui, Tokyo (JP); Ryo Nagata, Mishima (JP); Keisuke Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/110,188

(22) Filed: Aug. 23, 2018

(65) Prior Publication Data

US 2019/0064686 A1 Feb. 28, 2019

(30) Foreign Application Priority Data

Aug. 30, 2017 (JP) ..... 2017-166001

(51) Int. Cl.
*G03G 9/097* (2006.01)
*G03G 9/08* (2006.01)

(52) U.S. Cl.
CPC ..... *G03G 9/09708* (2013.01); *G03G 9/0819* (2013.01); *G03G 9/0975* (2013.01); *G03G 9/09716* (2013.01); *G03G 9/09725* (2013.01)

(58) Field of Classification Search
CPC ..... G03G 9/09708; G03G 9/09716; G03G 9/09725
USPC ..... 430/108.6
See application file for complete search history.

(56) References Cited

U.S. PATENT DOCUMENTS 8,889,330 B2 * 11/2014 Sugiura ..... G03G 9/0819 430/110.1
2018/0267416 A1 * 9/2018 Uchino ..... G03G 9/0825

FOREIGN PATENT DOCUMENTS

| | | | | |
|---|---|---|---|---|
| JP | 2000-35692 | A | | 2/2000 |
| JP | 2002-221819 | A | | 8/2002 |
| JP | 2006-023351 | A | * | 1/2006 |
| JP | 2015-137208 | A | | 7/2015 |
| JP | 2018-155912 | A | * | 10/2018 |

OTHER PUBLICATIONS

Japanese Patent Office English-language abstract and JPlatPat machine-assisted English-language translation of JP 2006-023351 (pub. Jan. 2006) (Year: 2006).*
Espacenet machine-assisted English-language translation of JP 2018-155912 (pub. Oct. 2018) (Year: 2018).*

* cited by examiner

*Primary Examiner* — Janis L Dote
(74) *Attorney, Agent, or Firm* — Canon U.S.A. Inc., IP Division

(57) ABSTRACT

A toner contains toner particles, titanate fine particles having a Group II element, and hydrotalcite compound fine particles as an external additive and satisfying
$10 \leq Lt \leq 80$ and
$100 \leq Lh \leq$ Weight average particle diameter (D4) of toner particles $\times 0.50$,
when the number average particle diameter (D1) of primary particles of the titanate fine particles is defined as Lt (nm) and the number average particle diameter (D1) of primary particles of the hydrotalcite compound fine particles is defined as Lh (nm).

8 Claims, No Drawings

TONER

BACKGROUND OF THE INVENTION

Field of the Invention

The present disclosure relates to a toner for use in image forming methods, such as an electrophotography.

Description of the Related Art

An electrophotographic image forming device has been demanded to increase the speed, prolong the life, save the energy, and reduce the size. In order to satisfy the demands, a toner also has been demanded to further improve various kinds of performance.

The toner has been particularly demanded to improve the quality stability, and, specifically, the following properties have been demanded:

- small image quality variation also in continuous use for a long period of time; and
- normal image quality in restarting after allowed to stand for several days after continuous use.

Until now, various kinds of toner and external additives have been proposed. For example, Japanese Patent Laid-Open No. 2000-35692 has proposed a toner to which a hydrotalcite compound is added as the external additive. According to this proposal, the toner to which the hydrotalcite compound is added can stably hold charges due to the presence of a plurality of kinds of metal ions, and thus the charge stability and the transferability of the toner are improved. Japanese Patent Laid-Open No. 2000-35692 also has proposed a toner in which strontium titanate powder is added as abrasives to toner particles.

Moreover, Japanese Patent Laid-Open No. 2002-221819 has proposed a toner to which a hydrotalcite compound with a small liberation ratio of magnesium atoms is added as the external additive. According to this proposal, a positively-charged hydrotalcite compound selectively electrostatically-adheres to a portion with an excessively high negative property of the toner surface, and therefore the charge amount distribution of the toner can be narrowed and uniformed. Moreover, for the purpose of stabilizing the charging, a toner in which strontium titanate powder with an average primary particle diameter of about 85 nm is added to toner particles has also been proposed.

Furthermore, Japanese Patent Laid-Open No. 2015-137208 has proposed, as external additives for toner, strontium titanate microscopic particles in which an $SrO/TiO_2$ molar ratio which is a component ratio of the strontium titanate is 0.80 or more and less than 0.95 and the average primary particle diameter is 0.02 to 0.5 μm. According to this proposal, by setting the component ratio to the specified component ratio, the coating by organic surface treatment agents, such as silicone oil, is facilitated, so that the hydrophobicicity can be increased and the environmental stability can be improved.

SUMMARY OF THE INVENTION

With the techniques proposed until now, it has been difficult to achieve a sufficient improvement of the following properties:

- small image quality variation also in continuous use for a long period of time; and
- normal image quality in restarting after allowed to stand for several days after continuous use.

One aspect of the present disclosure is directed to providing a toner which has solved the above-described disadvantage.

According to one aspect of the present disclosure, there is provided a toner containing toner particles and an external additive, wherein the external additive comprises titanate fine particles of which a Group II element is contained, and hydrotalcite compound fine particles, when a number average particle diameter (D1) of primary particles of the titanate fine particles is defined as Lt (nm), the Lt (nm) is 10 nm or more and 80 nm or less, when a number average particle diameter (D1) of primary particles of the hydrotalcite compound fine particles is defined as Lh (nm), the Lh (nm) satisfies a following condition: $100 \leq Lh \leq$ Weight average particle diameter (D4) of toner particles$\times 0.50$.

Further features of the present disclosure will become apparent from the following description of exemplary embodiments.

DESCRIPTION OF THE EMBODIMENTS

Hereinafter, the present disclosure is described in detail.

With respect to the property "small image quality variation also in continuous use for a long period of time", a certain effect can be expected by externally adding a hydrotalcite compound to toner particles. However, only by externally adding the hydrotalcite compound, a sufficient improvement of the property "normal image quality in restarting after allowed to stand for several days after continuous use" cannot be expected.

Then, the present inventors consider that it is indispensable to control charges to be imparted to the toner surface and have examined the use of titanate fine particles in combination. As a result of the examination, the present inventors have reached a conclusion that it is important to cause the titanate fine particles and hydrotalcite compound fine particles to be present on the toner particle surface in a specific state. Hereinafter, a detail description is given.

Heretofore, an effect expected from the hydrotalcite compound fine particles has been mainly a microcarrier effect of imparting charges to a toner in peeling. However, only by adding the hydrotalcite compound fine particles, the charges are localized, which has caused adverse effects in images.

In the present disclosure, high charges are imparted to a toner by the microcarrier effect, and then the charges are efficiently diffused onto the entire toner surface. The titanate fine particles are used as a substance (external additive) having a suitable charge diffusion ability for diffusion of charges.

The hydrotalcite compound fine particles generate negative charges by being rubbed against the other external additives adhering to the toner surface or the toner particle surface.

The titanate fine particles efficiently diffuse the charges onto the entire toner surface. The titanate fine particles have resistance lower than that of a resin component which is a main component of the toner particles, and therefore can diffuse the generated negative charges onto the toner particle surface (inside the particles)/between adjacent toner particles (between particles).

It is important for the relationship of the particle diameter between the hydrotalcite compound fine particles and the titanate fine particles that the hydrotalcite compound fine particles are larger. Due to such a relationship, the hydrotalcite compound fine particles move on the toner particle surface, and can sufficiently exhibit the effect as the microcarrier.

When the number average particle diameter (D1) of primary particles of the hydrotalcite compound fine particles is defined as Lh (nm), $100 \leq Lh \leq$ Weight average particle diameter (D4) of toner particles$\times 0.50$ is satisfied.

$100 \leq Lh \leq$ Weight average particle diameter (D4) of toner particles$\times 0.25$ is preferable and $100 \leq Lh \leq 650$ is more preferable.

When the number average particle diameter (D1) of the primary particles of the titanate fine particles is defined as Lt (nm), $10 \leq Lt \leq 80$ is satisfied, $10 \leq Lt \leq 70$ is preferable, and $10 \leq Lt \leq 50$ is more preferable.

The particle diameters of the hydrotalcite compound fine particles and the titanate fine particles are within the ranges mentioned above, the flowability of the toner is improved and a contact opportunity with the hydrotalcite compound fine particles increases, and therefore the effects of the present disclosure are more easily obtained.

When the particle diameter of the titanate fine particles is smaller, the titanate fine particles are more likely to be present in a state of uniformly adhering to the toner particle surface. Then, due to the uniform adhesion, the negative charges can be efficiently diffused onto the toner surface.

It is considered that the effects of the present disclosure described above can be effectively exhibited in a one-component development system.

In the one-component development system, a toner is conveyed by a developing roller within a development container, rubbed between a development blade and the developing roller, and then conveyed to the side of a photoconductor drum. When the toner passes through the development blade, the toner on the developing roller is conveyed in a state of being laminated on some layers and rotating. Due to the fact that the toner is conveyed while rotating, charges are generated on the toner surface described above. It is considered that, simultaneously with the generation of a phenomenon that the charges are diffused onto the toner surface, the charges generated thereon can be diffused onto the adjacent toner surface through the titanate fine particles by the rotation of the toner.

Thus, the charges on the toner surface on the developing roller passing through the development blade are more uniform and the charges are sufficient, good developability can be exhibited.

When the present inventors performed actual device evaluation by the one-component development system, both the properties that the image quality is not considerably changed also in continuous use for a long period of time and the image quality in restarting after allowed to stand for several days after continuous use is not considerably changed were able to be achieved.

Titanate Fine Particles Having a Group II Element

The titanate fine particles having a Group II element are described.

The Group II elements are elements (typical elements) belonging to Group II of the periodic table. The Group II elements include beryllium, magnesium, calcium, strontium, and barium. Examples of the titanate fine particles having a Group II element include beryllium titanate fine particles, magnesium titanate fine particles, calcium titanate fine particles, strontium titanate fine particles, and barium titanate fine particles. Among the above, the strontium titanate fine particles capable of widely diffusing charges imparted on the toner surface without deviation may be used.

The surface coverage ratio by the titanate fine particles on the toner particles is preferably 0.5% or more and 20.0% or less. When the surface coverage ratio is within the range mentioned above, the ratio of the titanate fine particles adhering in a primary particle state increases, and thus the titanate fine particles are likely to remain on the toner particle surface. Thus, the effects of the present disclosure are easily exhibited. A more preferable range is 0.5% or more and 10.0% or less.

The fixing ratio of the titanate fine particles to the toner particles is preferably 60% or more and 100% or less. Due to the fact that the fixing ratio is within the ranges mentioned above, the charges on the toner surface can be more effectively controlled. Thus, the effects of the present disclosure are easily exhibited. A more preferable range is 75% or more and 100% or less and a still more preferable range is 88% or more and 100% or less.

The content of the titanate fine particles is preferably 0.01 to 3.0 parts by mass and particularly preferably 0.01 to 2.0 parts by mass based on 100 parts by mass of the toner particles.

The titanate fine particles may be present in a proportion of 2 particles or more and 126 particles or less per 0.5 $\pi\mu m^2$ of the toner surface. The coefficient of variation of the number of particles is more preferably 0.5 or less. In this case, the contact opportunity with the hydrotalcite compound fine particles increases, and the microcarrier effect of the hydrotalcite compound fine particles is more efficiently exhibited. Furthermore, the titanate fine particles are uniformly present on the toner surface, and therefore the diffusion of the charges more efficiently occur, so that the effects of the present disclosure are more remarkable. The coefficient of variation of the number of particles is more preferably 0.3 or less.

The surface coverage ratio, fixing ratio, presence number of particles, and coefficient of variation described above can be controlled by adjusting the addition amount, particle diameter, and external addition conditions of the titanate fine particles and the quality of the toner particles.

The titanate fine particles may be surface-coated with treatment agents for improving charge adjustment or environmental stability.

As the treatment agents, a titanium coupling agent;

a silane-coupling agent;

silicone oil;

fatty acid metal salts, such as zinc stearate, sodium stearate, calcium stearate, zinc laurate, aluminum stearate, and magnesium stearate; and fatty acids, such as stearic acid can be exemplified.

Examples of treatment methods include a wet method including dissolving/dispersing a surface treatment agent or the like in a solvent, adding the titanate fine particles thereto, and removing the solvent under stirring or a dry method including directly mixing a coupling agent, fatty acid metal salts, and the titanate fine particles, and then performing treatment under stirring.

Hydrotalcite Compound Fine Particles

Next, the hydrotalcite compound fine particles are described.

The hydrotalcite compound is a layered inorganic compound which can be represented by the following general formula (A) and has a positively-charged basic layer ($[M^{2+}_{1-x}M^{3+}_{x}(OH)^{-}_{2}]$ in General Formula (A)) and a negatively-charged intermediate layer ($[x/nA^{n-}.mH_2O]$ in General Formula (A)):

$$([M^{2+}_{1-x}M^{3+}_{x}(OH)^{-}_{2}][x/nA^{n-}.mH_2O] \quad \text{General Formula (A).}$$

In General Formula (A), $M^{2+}$ represents divalent metal ions, such as $Mg^{2+}$ and $Zn^{2+}$, $M^{3+}$ represents trivalent metal ions, such as $Al^{3+}$ and $Fe^{3+}$, $A^{n-}$ represents n-valent anions, such as $CO_3^{2-}$, $Cl^-$, and $NO_3^-$, and $m \geq 0$ is established.

Examples of compounds contained in General Formula (A) include $[Mg^{2+}_{0.750}Al^{3+}_{0.25}(OH)^{-}_{2.000}][0.125\ CO_3^{2-}.0.500H_2O]$.

Thus, it is considered that the surfaces of the hydrotalcite compound fine particles are positively charged and the hydrotalcite compound fine particles are hard to be affected by moisture due to the structure. Therefore, it is considered that charges can be instantly imparted to the toner surface also in a high temperature and high humidity environment, and therefore the property "normal image quality in restarting after allowed to stand for several days after continuous use" can be achieved.

In the hydrotalcite compound, $Mg^{2+}$ may be used as the divalent metal ion $M^{2+}$ and $Al^{3+}$ may be used as the trivalent metal ion $M^{3+}$ from the viewpoint of a charge imparting ability. As the n-valent anion, $CO_3^{2-}$ and $Cl^-$ may be used from the viewpoint of imparting chargeability to toner particles.

The content of the hydrotalcite compound fine particles is preferably 0.01 to 3.00 parts by mass based on 100 parts by mass of the toner particles. When the content is within the range mentioned above, the effects of the present disclosure described above are easily obtained. The content is more preferably 0.01 to 1.00 part by mass.

The fixing ratio of the hydrotalcite compound fine particles to the toner particles is more preferably 20% or more and 60% or less. Due to the fact that the fixing ratio is within the range mentioned above, the microcarrier effect is more effectively exhibited and the effects of the present disclosure are more remarkable. A more preferable range is 40% or more and 60% or less.

The fixing ratio of the hydrotalcite compound fine particles to the toner particles can be controlled by adjusting the addition amount, particle diameter, and external addition conditions of the hydrotalcite compound fine particles and the quality of the toner particles.

The hydrotalcite compound fine particles may have an average aspect ratio of 1.5 or more. Due to the fact that the average aspect ratio of the hydrotalcite compound fine particles is 1.5 or more, the contact surface with the toner particles increases, so that the hydrotalcite compound fine particles are hard to strongly adhere/fix so as not to be movable on the toner particle surface. As a result, most of the fine particles are present in a state of being movable on the toner particle surface and the microcarrier effect is more sufficiently exhibited, so that the effects of the present disclosure are more remarkable. A more preferable range of the average aspect ratio is 1.8 or more and a still more preferable range is 2.5 or more. The average aspect ratio of the hydrotalcite compound fine particles can be controlled by adjusting a production method and external addition conditions of the hydrotalcite compound fine particles.

Toner Particles/Toner

The toner particles contain a colorant, wax, a charge control agent, and the like as necessary in addition to a binding resin. Hereinafter, each material contained in the toner particles is described.

Binding Resin

Examples of the binding resin include, for example, styrene-based monomers, such as styrene, p-chlorostyrene, and α-methylstyrene; acrylic acid ester monomers, such methyl acrylate, ethyl acrylate, n-propyl acrylate, n-butyl acrylate, lauryl acrylate, and 2-ethylhexyl acrylate; methacrylic acid ester monomers, such as methyl methacrylate, ethyl methacrylate, n-propyl methacrylate, lauryl methacrylate, and 2-ethylhexyl methacrylate; vinyl nitriles, such as acrylonitrile and methacrylonitrile; vinyl ethers, such as vinyl ethyl ether and vinyl isobutyl ether; and homopolymers or copolymers (vinyl-based resin) of vinyl methyl ketone, vinyl ethyl ketone, and vinyl isopropenyl ketone. In addition thereto, homopolymers or copolymers (olefin-based resin) of olefins, such as ethylene, propylene, butadiene, and isoprene; non-vinyl condensation resin, such as epoxy resin, polyester, polyurethane, polyamide, cellulosic resin, and polyether, graft polymers of the non-vinyl condensation resin and vinyl monomers, and the like are mentioned. The resins may be used alone or in combination of two or more kinds thereof. Among the above, polyester may be used because polyester has a sharp melt property and has excellent strength even in the case of a low molecular weight.

On the toner particle surface, polyester may be present. It is known that the polyester has a property of being more likely to be negatively charged as compared with the styrene acrylic resin. Thus, the generation of negative charges is further promoted by contact with the hydrotalcite compound fine particles present on the toner surface. As a result, the effects of the present disclosure are more remarkable.

Colorant

Examples of the colorant include known organic pigments or dyes, carbon black, magnetic powder, and the like.

Examples of cyan colorants include copper phthalocyanine compounds and derivatives thereof, anthraquinone compounds, basic dye lake compounds, and the like. Specifically, C.I. Pigment Blue 1, 7, 15, 15:1, 15:2, 15:3, 15:4, 60, 62, and 66 and the like are mentioned.

Examples of magenta colorants include condensed azo compounds, diketopyrrolopyrrole compounds, anthraquinones, quinacridone compounds, basic dye lake compounds, naphthol compounds, benzimidazolone compounds, thioindigo compounds, perylene compounds, and the like. Specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254; C.I. Pigment Violet 19, and the like are mentioned.

Examples of yellow colorants include compounds typified by condensed azo compounds, isoindolinone compounds, anthraquinone compounds, azo metal complexes, methine compounds, and allylamide compounds and the like. Specifically, C.I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194 and the like are mentioned.

Examples of black colorants include carbon black, magnetic powder, or those whose color is adjusted to black using the yellow colorants, the magenta colorants, and the cyan colorants.

The colorants can be used alone or as a mixture, or further in a solid solution state. The colorants are selected from the viewpoint of the hue angle, color saturation, brightness, lightfastness, OHP transparency, and dispersibility in the toner.

Wax

The wax is not particularly limited and the following substances are mentioned.

Mentioned are aliphatic hydrocarbon-based wax, such as low molecular weight polyethylene, low molecular weight polypropylene, low molecular weight olefin copolymers, microcrystalline wax, paraffin wax, and Fischer-Tropsch wax; oxides of the aliphatic hydrocarbon-based wax, such as oxidized polyethylene wax; wax containing fatty acid esters as a main component, such as aliphatic hydrocarbon-based ester wax; those obtained by partially or entirely deoxidizing fatty acid esters, such as deoxidized carnauba wax; partially esterified substances of fatty acids and polyhydric alcohols, such as behenic acid monoglyceride; and methyl ester compounds having a hydroxyl group obtained by hydrogenating vegetable fats and oils.

The content of the wax in the toner is preferably 1.0 part by mass or more and 20.0 parts by mass or less and more preferably 2.0 parts by mass or more and 15.0 parts by mass or less per 100 parts by mass of the binding resin.

The wax may have a maximum endothermic peak at 60° C. or more and 120° C. or less in the measurement by a differential scanning calorimeter (DSC). A more preferable range is 60° C. or more and 90° C. or less.

Charge Control Agent

As the charge control agent, the following substances are mentioned. Organometallic compounds and chelate compounds are effective and monoazo metallic compounds, acetylacetone metallic compounds, and aromatic oxycarboxylic acid-based, aromatic dicarboxylic acid-based, oxycarboxylic acid-based, and dicarboxylic acid-based metallic compounds are mentioned. In addition thereto, quaternary ammonium salts or resin type charge control agents can also be used. Examples of the resin type charge control agents include resins having sulfone functional groups, such as sulfonic acid groups, sulfonic acid bases, and sulfonic acid esters, and resins having carboxy groups. The toner of the present disclosure can contain the charge control agent alone or in combination of two or more kinds thereof.

A compounding amount of the charge control agent is preferably 0.01 part by mass or more and 20 parts by mass or less and more preferably 0.5 part by mass or more and 10 parts by mass or less based on 100 parts by mass of the binding resin.

A shape factor SF-2 of the toner particles is more preferably 110 or more and 180 or less.

The shape factor SF-2 is a value calculated by the following expression and is a value reflecting unevenness of the particle surface. The SF-2 closer to 100 means less unevenness.

$$SF\text{-}2=(\text{Peripheral length of particles})^2/\text{Particle area}\times 100/4\pi$$

When the SF-2 is within the range above, unevenness is present on the toner particle surface. Therefore, the contact opportunity of the hydrotalcite compound particles and the toner particles further increases, so that the generation of negative charges is further promoted. As a result, the effects of the present disclosure are more remarkable.

The weight average particle diameter (D4) of the toner particles is preferably 3.0 μm or more and 10.0 μm or less and more preferably 5.0 μm or more and 8.0 μm or less.

The toner of the present disclosure is one in which the titanate fine particles and the hydrotalcite compound fine particles are externally added to toner particles. On the toner surface, the hydrotalcite compound fine particles may be present in a predetermined dispersion state. Specifically, the hydrotalcite compound fine particles may be present in a state satisfying the following ratio:

$$(\text{Number of particles present in aggregated state})/(\text{Number of particles present in primary particle state})\geq 3.0.$$

The particles present in an aggregated state can maintain a movable state even when repeatedly rubbed, and therefore the ratio thereof may be higher. The ratio is more preferably 3.5 or more.

To the toner, silica fine particles may be externally added from the viewpoint of an improvement of chargeability or imparting fluidity in addition to the titanate fine particles and the hydrotalcite compound fine particles. The silica fine particles may be treated silica fine particles whose surface has been subjected to hydrophobic treatment. The treated silica fine particles may have a hydrophobicity measured by a methanol titration test of 30 to 80% by volume. The content of the silica fine particles is preferably 0.1 to 4.5 parts by mass and more preferably 0.1 to 3.0 parts by mass based on 100 parts by mass of the toner particles.

The weight average particle diameter (D4) of the toner is preferably 3.0 μm or more and 10.0 μm or less and more preferably 5.0 μm or more and 8.0 μm or less.

In the toner of the present disclosure, the total energy measured by FT-4 (powder rheometer) is more preferably 160 mJ or more and 300 mJ or less. The total energy is still more preferably 160 mJ or more and 280 mJ or less. The total energy measured by FT-4 is the total torque of the vertical torque and the rotation torque to be applied to a blade having a vane when the blade is caused to enter a toner layer which is formed so as to have a fixed condition while rotating and serves as the index of the fluidity of the toner.

Method for producing toner particles/toner

Subsequently, a method for producing toner particles is described.

A method for producing toner particles is not particularly limited. For example, methods for producing toner particles in hydrophilic media, such as a suspension polymerization method, an interfacial polymerization method, a dispersion polymerization method, and an emulsion aggregation method, and dry production methods, such as a pulverization method are mentioned. Particles produced by the methods mentioned above may be heat-spheroidized to be formed into toner particles.

Among the above, the emulsion aggregation method may be used because the shape control of toner particles is easy, the charge distribution uniformity is excellent, and a resin having a low softening point or a resin having an excellent sharp melt property is easily used. In the emulsion aggregation method, an aqueous dispersion of resin fine particles, an aqueous dispersion of colorant fine particles, and the like are individually prepared, and then mixed to aggregate and fuse the resin fine particles and the colorant fine particles to form toner particles.

First, the aqueous dispersion of resin fine particles and the aqueous dispersion of colorant fine particles are described.

Aqueous Dispersion of Resin Fine Particles

The aqueous dispersion of resin fine particles is prepared by known dispersion methods. Specifically, the aqueous dispersion of resin fine particles may be produced in water by emulsification using external shearing force including adding an aqueous medium, an emulsifier, and the like to resin, and then dispersing the mixture with a device applying high-speed shearing force, such as a CLEARMIX, a homomixer, or a homogenizer, for example. Moreover, a resin fine particle dispersion can be produced by a phase inversion emulsification method including melting resin in a solvent, dispersing the mixture into an aqueous medium in a particle shape together with an emulsifier, a polymer electrolyte, and the like by a disperser, such as a homogenizer, and then removing the solvent by performing heating or decompression. Alternatively, in the case of a resin fine particle dispersion containing resin fine particles containing a vinyl-based monomer as a constituent component, the resin fine particle dispersion may be produced by performing emulsion polymerization using an emulsifier.

Aqueous Dispersion of Colorant Fine Particles

The dispersion of colorant fine particles is prepared by dispersing colorant fine particles in an aqueous medium. The colorant fine particles are dispersed by known methods. For example, media type dispersers, such as a rotation shearing type homogenizer, a ball mill, a sand mill, and an Attritor, a high-pressure collision type disperser, and the like may be used. In particular, "Nanomizer" manufactured by Yoshida kikai co., ltd., "Altimizer" manufactured by SUGINO MACHINE LIMITED, and "Nanodisizer LPN series" manufactured by Serendip which are high-pressure collision type dispersers may be used.

Emulsifier

Examples of emulsifiers usable when preparing the aqueous dispersion include, but are not particularly limited thereto, anionic surfactants, such as a sulfuric acid ester salt type, a sulfonic acid salt type, a phosphoric acid ester type, and a soap type; cationic surfactants, such as an amine salt type and a quaternary ammonium salt type; and nonionic surfactants, such as a polyethylene glycol type, an alkyl phenol ethylene oxide adduct type, and a polyhydric alcohol type, for example. The emulsifiers may be used alone or in combination of two or more kinds thereof.

Aggregation Process

Aggregated particles are formed by mixing the aqueous dispersion of resin fine particles, the aqueous dispersion of colorant fine particles, and a dispersion in which the other components are dispersed, adding a pH adjuster, an aggregation agent, a stabilizer, and the like thereto, and then applying a temperature, mechanical power, and the like thereto as appropriate. The addition/mixing of the aggregation agent and the like may be performed at a temperature equal to or less than the glass transition point. When the mixing is performed under the temperature conditions, the aggregation proceeds in a stable state.

A cover layer (shell layer) can also be formed by causing second resin fine particles to adhere to the surface of the aggregated particles using a resin fine particle dispersion containing the second resin fine particles and aggregated particles having a core/shell structure can be obtained. Two or more of the cover layers can also be formed.

Maturing Process

A maturing process is a process of heating the aggregated particles to fuse the fine particles. Before the maturing process, a pH adjuster, a polar surfactant, and the like can be charged as appropriate in order to prevent the fusion between toner particles.

The heating temperature may be in the range of from the glass transition point temperature (glass transition temperature of a resin having the highest glass transition temperature in the case of two or more kinds of resins) of a resin contained in the aggregated particles to the decomposition temperature of the resin. Therefore, the heating temperature varies depending on the resin type of the polymer fine particles and cannot be unconditionally specified. In general, the heating temperature is the glass transition point temperature of the resin contained in the aggregated particles or more and 140° C. or less.

As the fusion time, short time is sufficient when the heating temperature is high and long time is required when the heating temperature is low. More specifically, the fusion time is dependent on the heating temperature and cannot be unconditionally specified and is generally 30 minutes or more and 10 hours or less.

The toner particles obtained by passing through each process described above can be subjected to solid-liquid separation according to known methods, the toner particles can be collected, and then the collected toner particles can be cleaned and dried, for example, under appropriate conditions.

External Addition Process

A toner of the present disclosure is obtained by externally adding the hydrotalcite compound fine particles and the titanate fine particles to the toner particles. Examples of external addition devices include a double cone mixer, a V type mixer, a drum type mixer, a super mixer, an FM mixer (manufactured by NIPPON COKE &. ENGINEERING CO., LTD.), a Nauta mixer, a Mechano Hybrid, and the like and the FM mixer (manufactured by NIPPON COKE &. ENGINEERING CO., LTD.) may be used.

The presence state of the titanate fine particles and the hydrotalcite compound fine particles can be controlled by adjusting the number of rotations of the external addition device, the treatment time, and the water temperature/the water amount of a jacket.

Method for Measuring Physical Properties

Method for Measuring Volume Resistivity of External Additive

The volume resistivity of the external additive was measured under the following conditions using a powder resistance measurement system (Powder resistance measurement unit MCP-PD51, High resistivity meter MCP-HT450: manufactured by Mitsubishi Chemical Analytech Co., Ltd.). As the external additive, a substance exposed to a temperature and relative humidity environment of 20° C./50% for 12 hours was used.

Sample: 2.0 g

Load: 20 kN

Measurement time: 10 seconds

Applied voltage range: 10 V to 1000 V

A value when the applied voltage is 1000 V was set as the volume resistivity of the external additive.

Method for Measuring Hydrophobicity (% by Volume) of Titanate Fine Particles

The hydrophobicity (% by volume) of the titanate fine particles is measured by a powder wettability tester "WET-100P" (manufactured by RHESCA CO., LTD.).

A spindle-shaped rotator coated with fluororesin having a length 25 mm and a maximum body diameter of 8 mm is placed in a cylindrical glass container having a diameter 5 cm.

In the cylindrical glass container, 70 mL of hydrous methanol liquid containing 50% by volume of methanol and 50% by volume water is placed. Thereafter, 0.5 g of the titanate fine particles is added, and then the container is set in the powder wettability tester.

Methanol is added into the liquid at a speed of 0.8 mL/min through the powder wettability tester under stirring at a rate of 3.3 $s^{-1}$ using a magnetic stirrer.

The transmittance is measured with light with a wavelength of 780 nm, and a value expressed by the volume percentage (=Methanol volume/(Methanol volume+Water volume)×100) of the methanol when the transmittance reaches 50% is set as the hydrophobicity. According to the hydrophobicity of a specimen, a volume ratio of the first methanol to the water is adjusted as appropriate.

The titanate fine particles to be used as the specimen may be measured as they are when the fine particles themselves are available. However, when only a toner to which the titanate fine particles are externally added is available, the titanate fine particles are isolated from the toner and measured.

Method for Measuring Number Average Particle Diameter (D1) of Primary Particles of Titanate Fine Particles and Number Average Particle Diameter (D1) of Primary Particles of Hydrotalcite Compound Fine Particles The presence location of the titanate and the hydrotalcite compound present on the toner surface can be specified by the observation under an ultra-high resolution scanning electron microscope S-4800 (Hitachi High-Technologies Corp.) (SEM-EDX) and by elemental analysis. For example, when the observation and the elemental mapping were performed under a magnification of 20,000 times in a continuous visual field, and then the presence of both the elements of Ti and Sr was able to be confirmed for the particles to be observed, the particles were determined to be strontium titanate. Similarly, when both the elements of Mg and Al were mapped for the particles to be observed, the particles were determined to be the hydrotalcite compound fine particles.

Hereinafter, a method for measuring the number average particle diameter of the primary particles of the titanate fine particles is described.

(1) Specimen Production

A conductive paste is thinly applied to a specimen stand (15 mm×6 mm aluminum specimen stand), and then a toner is sprayed onto the specimen stand. Furthermore, air blow is performed to remove excessive toner from the specimen stand and to sufficiently dry the same. The specimen stand is set in a specimen holder, and then the specimen stand height is adjusted to 36 mm with a specimen height gauge.

(2) S-4800 Observation Condition Setting

Liquid nitrogen is poured into an anticontamination trap attached to a chassis of S-4800 until the liquid nitrogen overflows, and then the S-4800 was allowed to stand for 30 minutes. "PCSTEM" of the S-4800 is started to perform flashing (cleaning of an FE chip which is an electron source). An acceleration voltage display portion of a control panel on a screen is clicked, and then pressing a [Flashing] button to open a flashing execution dialog. It is confirmed that the flashing intensity is 2, and then the flashing is executed. It is confirmed that an emission current by the flashing is 20 to 40 μA. The specimen holder is inserted into a specimen chamber of the S-4800 chassis. [Home] on the control panel is pressed to move the specimen holder to an observation position.

An acceleration voltage display portion is clicked to open an HV setting dialog to set the acceleration voltage to [0.8 kV] and the emission current to [20 μA]. In a [SEM] tab of an operation panel, Signal Select is set to [SE], [Upper (U)] and [+BSE] are selected for an SE detector, and then [L.A.100] is selected in a selection box on the right side of [+BSE] to set a mode so that an observation is performed with a reflected electron image. In the [SEB] tab on the same operation panel, Probe Current is set to [Normal], Focus Mode is set to [UHR], and WD is set to [3.0 mm] in OPE. Condition block. Then, an [ON] button of the acceleration voltage display portion of the control panel is pressed to apply the acceleration voltage.

(3) Observation by S-4800

The inside of the magnification display portion of the control panel is dragged to set the magnification to 100000 (100 k) times. A focus knob [COARSE] of an operation panel is rotated to adjust the aperture alignment at a position where focus is achieved to a certain degree. [Align] of the control panel is clicked to display an alignment dialog, and then [Beam] is selected. A STIGMA/ALIGNMENT knob (X,Y) of the operation panel is rotated to move a displayed beam to the center of a concentric circle. Next, [Aperture] is selected, the STIGMA/ALIGNMENT knob (X,Y) is turned in increments of 1 to stop the motion of an image or set the motion to the minimum motion. Then the aperture dialog is closed, and then focus is automatically achieved. This operation is further repeated twice to achieve focus.

Thereafter, the particle diameter is measured for at least 300 titanate fine particles having a Group II element on the toner surface to determine the number average particle diameter (D1) of primary particles. Some of the titanate fine particles are present as aggregated particles but the particle diameter of such aggregated particles is not measured. By treating the maximum diameter of the particles as the particle diameter and arithmetically averaging the maximum diameter, the number average particle diameter (D1) of the primary particles is obtained.

The number average particle diameter (D1) of primary particles of the hydrotalcite compound fine particles is measured and calculated in the same manner as the number average particle diameter (D1) of the primary particles of the titanate fine particles, so that the number average particle diameter (D1) of the primary particles is obtained.

Method for Measuring Surface Coverage Ratio by Titanate Fine Particles on Toner Particles The surface coverage ratio by the titanate fine particles on the toner particles is measured by ESCA (X-ray photoelectron spectroscopy analysis). For example, when the titanate fine particles are strontium titanate fine particles, the surface coverage ratio is calculated from the strontium atomic weight. The ESCA is an analysis method of detecting atoms in a region of several nanometers or less in the depth direction of the specimen surface. Therefore, atoms of the surface of organic and inorganic composite fine particles can be detected.

As a sample holder, a 75 mm square platen (having a screw hole having a diameter of about 1 mm for sample fixation) attached to a device was used. The screw hole of the platen penetrates the platen, and therefore the hole is closed with resin or the like to produce a concave portion for powder measurement having a depth of about 0.5 mm. The concave portion is filled with a measurement specimen (toner), and then the specimen is levelled off with a spatula or the like to thereby produce a sample.

The device and measurement conditions of the ESCA are as follows.

Used device: Quantum 2000 manufactured by ULVAC-PHI, INCORPORATED.

Analysis method: Narrow analysis

Measurement Conditions:

X-ray source: Al-Kα

X-ray conditions: 100μ, 25 W, 15 kV

Photoelectron capturing angle: 45°

Pass Energy: 58.70 eV

Measurement range: ϕ100 μm

The analysis method includes first correcting the peak originating from a C—C bond of the carbon 1s orbit to 285 eV. Thereafter, the Sr amount originating from strontium to the total amount of constituent elements is calculated by the use of a relative sensitivity factor provided by ULVAC-PHI, INCORPORATED., from the peak area originating from the strontium 2p orbit where the peak top is detected in the range of from 100 to 105 eV. Moreover, the same measurement is performed using strontium titanate particles to calculate the Sr amount in that case, and then the proportion of the Sr amount when the value is set to 100% is calculated. The case where titanate is strontium titanate is described. However, when the titanate is not strontium titanate, the metal type contained in titanate may be specified from database attached to a measurement device, and then analysis focusing on the metal type may be performed.

Method for Measuring Fixing Ratio of Titanate Fine Particles and Hydrotalcite Compound Fine Particles to Toner Particles First, two types of samples (toner before washing with water and toner after washing with water) are prepared.

(i) Toner before washing with water: Various kinds of toner produced in Examples described later were used as they were.

(ii) Toner after washing with water: 160 g of sucrose (manufactured by Kishida Chemical Co., Ltd.) is added to 100 mL of ion exchanged water, and then dissolved under warming in hot water to prepare concentrated sucrose liquid. In a centrifugal separation tube, 31 g of the concentrated sucrose liquid and 6 mL of Contaminon N (10% by mass aqueous solution of precision measuring device washing neutral detergent containing a nonionic surfactant, an anionic surfactant, and an organic builder and having pH 7, manufactured by Wako Pure Chemical Industries, Ltd.) are placed to produce dispersion liquid. To the dispersion liquid, 1 g of the toner is added to loosen a lump of the toner with a spatula or the like. The centrifugal separation tube is shaken with a shaker at 5.8 $s^{-1}$ for 20 min After shaken, a solution is placed in a glass tube for swing rotor (50 mL), and then centrifuged with a centrifugal separator under the conditions of 58.3 $s^{-1}$ and 30 min. It is visually confirmed that the toner and the aqueous solution are sufficiently separated, and then the toner divided into the top layer is collected with a spatula or the like. The aqueous solution containing the collected toner is filtered with a vacuum filter, and then dried with a drier for 1 hour or more to obtain a sample.

With respect to the samples before and after washing with water, the titanate fine particles having a Group II element were quantified by the use of the strength of a target element (Sr when strontium titanate fine particles were used as the titanate fine particles having a Group II element and Mg when the hydrotalcite compound fine particles were used) by a wavelength dispersion type X-ray Fluorescence Analysis (XRF) to determine the adhesion amount.

As the measurement sample, about 1 g of the toner after washing with water and the initial toner was placed in a dedicated aluminum ring for pressing, leveled, and then pressurized at 20 MPa for 60 seconds using a pelleting pressing machine "BRE-32" (manufactured by Maekawa Testing Machine Mfg. Co., Ltd.) to mold the same into pellets having a thickness of about 2 mm, and the molded pellets were used.

As the measuring device, a wavelength dispersion type X-ray Fluorescence Analysis apparatus "Axios" (manufactured by PANalytical) and bundled dedicated software "SuperQ ver. 4.0F" (manufactured by PANalytical) for setting the measurement conditions and analyzing measurement data are used. As an anode of an X-ray tube, Rh is used, the measurement atmosphere is a vacuum, the measurement diameter (collimator mask diameter) is set to 10 mm, and the measurement time is set to 10 seconds. In the case of measuring light elements, the light elements are detected with a proportional counter (PC). In the case of measuring heavy elements, the heavy elements are detected with a scintillation counter (SC). The measurement is performed under the above-described conditions, and then the elements are identified based on the obtained X-ray peak positions, whereby the concentration thereof is calculated from the counting rate (unit: cps) which is the number of X-ray photons per unit time.

With respect to the fixing ratio from the toner, the strength of elements of the toner before washing with water and the toner after washing with water is determined. Thereafter, the fixing ratio is calculated based on the following expression. As an example, an expression when strontium titanate fine particles are used as titanate fine particles and Sr is used as the target element is shown:

Strontium titanate fixiong ratio=(Strength of Sr elements of toner after washing with water)/(Strength of Sr elements of toner before washing with water)×100.

Number and Coefficient of Variation of Titanate Fine Particles on Toner Surface

The coefficient of variation indicating the presence state of the titanate fine particles on the toner surface is confirmed with a scanning electron microscope.

More specifically, the toner particles are photographed at a magnification of 20,000 times in a reflected electron image of the scanning electron microscope. The photographed image is captured into image-processing software, a reference point P is provided on the surface of projection of the toner particles, and then a circle having a radius of 2 μm (radius of 4 cm in an image enlarged by 20,000 times) is drawn with the reference point P as the central point. The reference point P may be anywhere insofar as the circle having a radius of 2 μm is within the reflected electron image of the toner.

Next, in the reflected electron image of the toner particles photographed at a magnification of 20,000 times, straight lines dividing the circle into eight regions in increments of 45° from the reference point P (central point) of the surface of projection of the toner particles toward the outer periphery of the surface of projection of the toner particles are drawn.

The number of the titanate fine particles observed in each of the eight divided regions is counted, and then the average value and the standard deviation are calculated. Thereafter, the coefficient of variation is calculated from the following expression:

(Coefficient of variation)=(Standard deviation of number of particles)/(Average number of particles).

More specifically, the coefficient of variation of the number of the titanate fine particles on a toner particle surface S specified in the present disclosure is a coefficient of variation of the number of the titanate fine particles present on the eight divided regions (0.5 $\pi\mu m^2$) of the circle having a radius of 2 μm.

Method for Measuring Aspect Ratio of Hydrotalcite Compound Present on Toner Surface An image with a magnification of 20,000 times and a resolution of 2048×1356 pixels photographed with the scanning electron microscope S-4800 (Hitachi High-Technologies Corp.) was captured into a personal computer. From the image, particles were recognized by means of an easy download tool using an image analysis device "MacView Ver.4" manufactured by Mountech Co., Ltd., and then the aspect ratio was measured from a ratio (A/B) of the major axis (A) to the minor axis (B) of the particles. The major axis (A) is defined as the maximum value of the distances between two points on the particle surface. The minor axis (B) is defined as the local maximal value in a distribution obtained by measuring the particle widths in a direction orthogonal to the major axis. When two or more of the local maximal values are present, the average value thereof is defined as the minor axis (B). The measurement is performed for arbitrary 200 particles having a circle-equivalent diameter of 50 nm or more, and then the arithmetic average value is defined as the average aspect ratio. When the photographed particles are aggregated particles (secondary particles), the measurement is performed by regarding the secondary particles as single particles.

Method for Measuring Shape Factor SF-2 of Toner Particles

The toner particles were observed under the scanning electron microscope S-4800 (Hitachi High-Technologies Corp.), and then the peripheral length and the area of the particles present as primary particles were calculated in a visual field enlarged by 20,000 times using image-processing software Image-Pro. Plus 5.1 J (manufactured by Media Cybernetics). The SF-2 was calculated using the obtained peripheral length and area by the following expression:

$$SF\text{-}2=(\text{Peripheral length of particles})^2/\text{Particle area}\times 100/4\pi.$$

The same observation/measurement is performed for 100 toner particles, and then the arithmetical average value of the obtained SF-2 values is calculated to be defined as the SF-2 specified in the present disclosure.

Method for Measuring Weight Average Particle Diameter (D4) of Toner Particles and Toner The weight average particle diameter (D4) of the toner particles and the toner are calculated as follows. As a measuring device, a precision particle size distribution meter "Coulter counter Multisizer 3" (Registered Trademark, manufactured by Beckman Coulter) by an aperture impedance method having a 100 μm aperture tube is used. For the setting of the measurement conditions and the analysis of measurement data, bundled dedicated software "Beckman Coulter Multisizer 3 Version 3.51" (manufactured by Beckman Coulter) is used. The measurement is performed at an effective measuring channel number of 25,000.

As an electrolyte aqueous solution for use in the measurement, one obtained by dissolving a special grade sodium chloride in ion exchanged water to achieve a concentration of about 1% by mass, e.g., "ISOTON II" (manufactured by Beckman Coulter), is usable.

Before performing the measurement and the analysis, dedicated software is set as follows.

In "Changing Standard Operating Method (SOM)" screen of the dedicated software, the total count number of a control mode is set to 50000 particles, the number of times of measurement is set to 1, and, as a Kd value, a value obtained using "10.0 μm standard particles" (manufactured by Beckman Coulter) is set. A "Threshold/Noise level measurement button" is pressed to automatically set the threshold and the noise level. The current is set to 1600 μA, the gain is set to 2, an electrolyte aqueous solution is set to ISOTON II, and a check mark is placed in "Flush aperture tube after measurement".

In the "Setting for conversion from pulse to particle diameter" screen of the dedicated software, a bin interval is set to a logarithmic particle diameter, the number of particle diameter bins is set to 256 particle diameter bins, and a particle diameter range is set to the range of 2 μm to 60 μm.

A specific measurement method is as described below.

(1) About 200 mL of the electrolyte aqueous solution is charged into a 250 mL round-bottom glass beaker dedicated for the Multisizer 3. The beaker is set in a sample stand, and stirred with a stirrer rod at 24 rotations/sec in a counter-clockwise direction. Then, dirt and bubbles in the aperture tube are removed by the "Aperture flush" function of the dedicated software.

(2) About 30 mL of the electrolyte aqueous solution is charged into a 100 mL flat-bottom glass beaker. About 0.3 mL of a diluted solution prepared by diluting "Contaminon N" (10% by mass aqueous solution of a precision measuring device washing neutral detergent containing a nonionic surfactant, an anionic surfactant, and an organic builder and having a pH of 7, manufactured by Wako Pure Chemical Industries, Ltd.) with ion-exchanged water by about 3 mass fold is added as a dispersant thereinto.

(3) An ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180° and which has an electrical output of 120 W is prepared. About 3.3 L of ion-exchanged water is charged into a water tank of the ultrasonic dispersing unit. About 2 mL of Contaminon N is charged into the water tank.

(4) The beaker in the section (2) above is set in a beaker fixing hole of the ultrasonic dispersing unit, and then the ultrasonic dispersing unit is operated. Then, the height position of the beaker is adjusted so that the resonance state of the liquid level of the electrolyte aqueous solution in the beaker is the maximum.

(5) About 10 mg of a measurement specimen is gradually added to and dispersed in the electrolyte aqueous solution in a state where the electrolyte aqueous solution in the beaker in the section (4) above is irradiated with the ultrasonic waves. Then, the ultrasonic dispersion treatment is continued for an additional 60 seconds. The temperature of water in the water tank is appropriately adjusted so as to be 10° C. or more and 40° C. or less in the ultrasonic dispersion.

(6) The electrolyte aqueous solution in the section (5) above in which the toner has been dispersed is added dropwise with a pipette to the round-bottom beaker in the section (1) above placed in the sample stand to adjust the concentration of the toner to be measured to about 5%. Then, the measurement is performed until the number of the measured particles has reached 50,000 particles.

(7) The measurement data is analyzed with the dedicated software included with the apparatus, and the weight average particle diameter (D4) is calculated. An "Average diameter" on the "Analysis/Number statistics (arithmetic average)" screen when a Graph/% by volume is set in the dedicated software is the weight average particle diameter (D4).

Method for Measuring Ratio of Number of Primary Particles and Number of Aggregated Particles of Hydrotalcite Compound Fine Particles Present on Toner Surface The toner was observed under the scanning electron microscope S-4800 (Hitachi High-Technologies Corp.). In a visual field enlarged by 30,000 times, 100 toners were observed to calculate a ratio of the number of primary particles to the number of aggregated particles from the shape of the hydrotalcite compound. The shape of the primary particles of the hydrotalcite compound fine particles is a flat shape in many cases. The particles present in a state where the flat particles are overlapped with each other are determined to be aggregated particles.

Method for Measuring Total Energy of FT-4 (Powder Rheometer) which is Liquidity Index of Toner The total energy can be measured by the use of a powder liquidity analyzer, Powder rheometer FT-4 (manufactured by Freeman Technology) (hereinafter sometimes abbreviated as "FT-4").

The device moves a blade in a powder sample to cause a fixed flow measurement and pattern flow. The particles in the sample flow when the blade approaches. When passing, the blade falls thereafter, and then stands still again. The energy required for the blade to move in the powder is calculated, and then various liquidity indices are calculated from the value. The blade is a propeller type. Simultaneously with rotation, the blade moves upward or downward, and therefore the tip draws a spiral. The angle or the speed of the spiral path of the blade can be adjusted by changing the rotational speed and the vertical motion. When the blade moves along the clockwise spiral path, there is an action of uniformly mixing powder. Conversely, when the blade moves along the counterclockwise spiral path, the blade receives resistance from powder.

Specifically, the measurement is performed by the following operations. In all the operations, as the propeller blade, a 48 mm diameter blade dedicated for FT-4 measurement is used (in which the rotation axis is present in the normal direction at the center of a 48 mm×10 mm blade plate and the blade plate is smoothly twisted counterclockwise in such a manner that both outermost edge portions (a 24 mm portion from the rotation axis) are twisted by 70° and a 12 mm portion from the rotation axis is twisted by 35° and which contains SUS, Model: C210 (hereinafter sometimes abbreviated as "blade").

First, 100 g of toner allowed to stand in an environment of 23° C. and 60% for 3 or more days is placed in a 50×160 mL split container dedicated for the FT-4 measurement (Model: C203, in which the height from the bottom surface of the container to a split portion is 82 mm and contains glass as a material, hereinafter sometimes abbreviated as "container") to thereby form a toner powder layer.

(1) Conditioning Operation (a) The blade is caused to enter to reach a position at a distance of 10 mm from the bottom surface of the powder layer from the surface of the toner powder layer in a clockwise rotation direction relative to the surface of the powder layer (direction in which the powder layer is loosened by the rotation of the blade) at a rotational speed (peripheral speed of each outermost edge portion of the blade) of 60 (mm/sec) and at a speed at which the blade is caused to enter in a direction perpendicular to the powder layer is such that an angle formed between a path drawn by each outermost edge portion of the blade during the movement and the surface of the powder layer is 5 (deg) (hereinafter sometimes abbreviated as "angle formed").

Thereafter, the operation of causing the blade to enter a position at a distance of 1 mm from the bottom surface of the toner powder layer in a clockwise rotation direction relative to the surface of the powder layer is performed at a rotational speed of the blade of 60 (mm/sec) and a speed at which the blade is caused to enter the powder layer in a direction perpendicular to the powder layer is such that the angle formed is 2 (deg).

Thereafter, the blade is moved to a position at a distance of 100 mm from the bottom surface of the toner powder layer in a clockwise rotation direction relative to the surface of the powder layer at a rotational speed of the blade of 60 (mm/sec) and a speed at which the blade is pulled out of the powder layer is such that the angle formed is 5 (deg), and then pulled out.

After the completion of the pulling-out, the blade is rotated in the clockwise and counterclockwise directions alternately to a small extent so that the toner adhering to the blade is shaken off.

(b) A series of operations in the section (1)-(a) above is performed five times, whereby air involved in the toner powder layer is removed. Thus, a stable toner powder layer is produced.

(2) Split Operation

The toner powder layer is leveled off at the split portion of a cell dedicated for the measurement with the FT-4 described above, and then the toner in an upper portion of the powder layer is removed, whereby toner powder layers having the same volume are formed.

(3) Measurement Operation (i) Measurement of Total Energy (a) An operation similar to the operation of the section (1)-(a) above is performed once.

(b) Next, the blade is caused to enter to reach a position at a distance of 10 mm from the bottom surface of a toner powder layer in a counterclockwise rotation direction relative to the surface of the powder layer (direction in which the powder layer is squeezed by the rotation of the blade) at a rotational speed of the blade of 100 (mm/sec) and a speed at which the blade is caused to enter the powder layer in a direction perpendicular to the powder layer is such that the angle formed is 5 (deg).

Thereafter, an operation of causing the blade to enter a position at a distance of 1 mm from the bottom surface of the powder layer in a clockwise rotation direction relative to the surface of the powder layer is performed at a rotational speed of the blade of 60 (mm/sec) and a speed at which the blade is caused to enter the powder layer in the direction perpendicular to the powder layer is such that the angle formed is 2 (deg).

Thereafter, the blade is pulled out to a position at a distance of 100 mm from the bottom surface of the powder layer in a clockwise rotation direction relative to the surface of the powder layer at a rotational speed of the blade of 60 (mm/sec) and a speed at which the blade is pulled out of the powder layer in a direction perpendicular to the powder layer is such that the angle formed is 5 (deg).

When the pulling-out is completed, the blade is rotated in the clockwise and counterclockwise directions alternately to a small extent so that the toner adhering to the blade is shaken off.

(c) A series of the operations in the section (b) above is repeated seven times.

The total of a rotation torque and a vertical load obtained when the blade is caused to enter to reach the position at a distance of 10 mm from the bottom surface of the powder layer from the position at a distance of 100 mm from the bottom surface of the powder layer is defined as a total energy (mJ) when the rotational speed of the blade in the seventh repetition is 100 (mm/sec).

EXAMPLES

The present disclosure is described in more detail with reference to Examples and Comparative Examples but the present disclosure is not limited thereto at all.

Production Example 1 of Titanate Fine Particles

Metatitanic acid obtained by a sulfuric acid method was subjected to deferrization and bleaching treatment, and then a sodium hydroxide aqueous solution was added to set the pH to 9.0. Then, desulfurization treatment was performed, and thereafter the resultant substance was neutralized to pH 5.8 by hydrochloric acid, and then filtration and washing with water were performed. Water was added to a washed cake to form a 1.85 mol/L slurry in terms of $TiO_2$, hydrochloric acid was added to set the pH to 1.0, and then deflocculant treatment was performed.

1.88 mol of the metatitanic acid in terms of $TiO_2$ subjected to the desulfurization and the deflocculant was collected, and then charged into a 3 L reaction container. 2.16 mol of strontium chloride aqueous solution was added to the deflocculated metatitanic acid slurry so that the Sr/Ti molar ratio was 1.15, and then the resultant slurry was adjusted 1.039 mol/L in terms of $TiO_2$ concentration. Next, the resultant slurry was warmed to 90° C. under stirring and mixing, 440 mL of 10 mol/L sodium hydroxide aqueous solution was added over 45 minutes, and then the stirring was continued at 95° C. for 1 hour to complete the reaction.

The reaction slurry was cooled to 50° C., hydrochloric acid was added until the pH reached 5.0, and then stirring was continued for 20 minutes. The obtained precipitation was subjected to decantation and cleaning, filtered and separated, and then dried in a 120° C. atmosphere for 8 hours.

Subsequently, 300 g of the dried product was charged into a dry type particle compositing apparatus (manufactured by HOSOKAWA MICRON, Nobilta NOB-130). Crushing treatment was performed for 10 minutes at a treatment temperature of 30° C. with a rotary treatment blade at 90 m/sec. Thereafter, the treated product was moved to another container, hydrochloric acid was added until the pH reached 0.1, and then stirring was continued for 1 hour. The generated precipitation was subjected to decantation and cleaning.

The slurry containing the obtained precipitation was adjusted to 40° C., hydrochloric acid was added to adjust the pH to 2.5, 4.0% by mass n-octyl triethoxysilane based on the solid content was added, and then stirring was continued for 10 hours. 5 mol/L sodium hydroxide solution was added to adjust the pH to 6.5, and then the holding of stirring was continued for 1 hour. Thereafter, filtration and cleaning were performed, followed by drying in a 120° C. atmosphere for 8 hours, whereby titanate fine particles T-1 were obtained. The hydrophobicity of the titanate fine particles T-1 was 77 (% by volume). Table 1 shows the physical properties of the obtained titanate fine particles T-1.

Production Example 2 of Titanate Fine Particles

Titanate fine particles T-2 were produced in the same manner as in Production Example 1, except changing Production Example 1 so as to adjust the $TiO_2$ concentration after adding the strontium chloride aqueous solution to the deflocculated metatitanic acid slurry to 1.015 mol/L.

The hydrophobicity of the titanate fine particles T-2 was 75 (% by volume). Table 1 shows the physical properties of the obtained titanate fine particles T-2.

Production Example 3 of Titanate Fine Particles

Titanate fine particles T-3 were produced in the same manner as in Production Example 1, except changing Production Example 1 so as to add 2.54 mol of strontium chloride aqueous solution to the deflocculated metatitanic acid slurry so that the Sr/Ti molar ratio was 1.35 and changing Production Example 1 so as to perform warming to 95° C. after the addition.

The hydrophobicity of the titanate fine particles T-3 was 76 (% by volume). Table 1 shows the physical properties of the obtained titanate fine particles T-3.

Production Example 4 of Titanate Fine Particles

Titanate fine particles T-4 were produced in the same manner as in Production Example 3, except changing Production Example 3 so as to perform warming to 100° C. after adding the strontium chloride aqueous solution to the deflocculated metatitanic acid slurry.

The hydrophobicity of the titanate fine particles T-4 was 78 (% by volume). Table 1 shows the physical properties of the obtained titanate fine particles T-4.

Production Example 5 of Titanate Fine Particles

Titanate fine particles T-5 were produced in the same manner as in Production Example 1, except changing Production Example 1 so as to adjust the $TiO_2$ concentration after adding the strontium chloride aqueous solution to the deflocculated metatitanic acid slurry to 1.083 mol/L and changing Production Example 1 so as to perform warming to 85° C. after the addition.

The hydrophobicity of the fine particles T-5 of titanate was 69 (% by volume). Table 1 shows the physical properties of the obtained titanate fine particles T-5.

Production Example 6 of Titanate Fine Particles

Metatitanic acid obtained by a sulfuric acid method was subjected to deferrization and bleaching treatment, and then a sodium hydroxide aqueous solution was added to set the pH to 9.0. Then, desulfurization treatment was performed, the resultant substance was neutralized to pH 6.0 by hydrochloric acid, and then filtration and washing with water were performed. Water was added to a washed cake to form a slurry having a $TiO_2$ concentration of 1.85 mol/L, hydrochloric acid was added to set the pH to pH 1.0, and then deflocculant treatment was performed.

0.625 mol of the metatitanic acid subjected to the desulfurization and the deflocculant was collected as $TiO_2$, and then charged into a 3 L reaction container. 0.719 mol of strontium chloride aqueous solution was added to the deflocculated metatitanic acid slurry so that the Sr/Ti molar ratio was 1.00, and then adjusted so that the $TiO_2$ concentration was 0.313 mol/L. Next, the resultant slurry was warmed to 90° C. under stirring and mixing, 296 mL of 5 mol/L sodium hydroxide aqueous solution was added over 18 hours, and then the stirring was continued at 95° C. for 1 hour to complete the reaction.

The slurry after the reaction was cooled to 50° C., hydrochloric acid was added until the pH reached 5.0, and then stirring was continued for 1 hour. The obtained precipitation was subjected to decantation and cleaning.

The slurry containing the obtained precipitation was adjusted to 40° C., hydrochloric acid was added to adjust the pH to 2.5, 4.0% by mass n-octyl triethoxysilane based on the solid content was added, and then stirring was continued for 10 hours. 5 mol/L sodium hydroxide solution was added to adjust the pH to 6.5, and then stirring was continued for 1 hour, and then a cake obtained by filtration and cleaning was dried in a 120° C. atmosphere for 8 hours to give titanate fine particles T-6. The hydrophobicity of the titanate fine particles T-6 was 78 (% by volume). Table 1 shows the physical properties of the obtained titanate fine particles T-6.

Production Example 7 of Titanate Fine Particles 0.92 mol/L NaOH aqueous solution was held at about 90° C., and then a $TiCl_4$ aqueous solution ($TiCl_4$ concentration of 0.472 mol/L) held at 40° C. and a $BaCl_2$/NaOH aqueous solution ($BaCl_2$ concentration of 0.258 mol/L and NaOH concentration of 2.73 mol/L) from which an undissolved content was removed beforehand and heated to and held at about 100° C. was continuously supplied into a reaction vessel. The temperature of the mixed aqueous solution was fixed at about 90° C., and then stirred for 2 minutes to generate particulate barium titanate. After maturing, decantation and cleaning were performed.

The slurry containing the precipitation was adjusted to 40° C., hydrochloric acid was added to adjust the pH to 2.5, 4.0% by mass n-octyl triethoxysilane based on the solid content was added, and then the holding of stirring was continued for 10 hours. 5 mol/L sodium hydroxide solution was added to adjust the pH to 6.5, stirring was continued for 1 hour, and then a cake obtained by filtration and cleaning was dried in a 120° C. atmosphere for 8 hours to give titanate fine particles T-7. The hydrophobicity of the titanate fine particles T-7 was 75 (% by volume). Table 1 shows the physical properties of the obtained titanate fine particles T-7.

TABLE 1

| Titanate fine particles | | | | |
|---|---|---|---|---|
| No. | Composition | Number average particle diameter of primary particles (nm) | Volume resistivity (Ω · cm) | Hydrophobicity (% by volume) |
| T-1 | Strontium titanate | 35 | $6 \times 10^{11}$ | 77 |
| T-2 | Strontium titanate | 50 | $5 \times 10^{11}$ | 75 |
| T-3 | Strontium titanate | 70 | $5 \times 10^{11}$ | 76 |
| T-4 | Strontium titanate | 80 | $5 \times 10^{11}$ | 78 |
| T-5 | Strontium titanate | 10 | $6 \times 10^{11}$ | 69 |
| T-6 | Strontium titanate | 85 | $5 \times 10^{11}$ | 78 |
| T-7 | Barium titanate | 36 | $6 \times 10^{11}$ | 75 |

Production Example 1 of Hydrotalcite Compound Fine Particles 203.3 g of magnesium chloride hexahydrate and 96.6 g of aluminum chloride hexahydrate were dissolved in 1 L of deionized water, and then the pH was adjusted to 10.5 with liquid in which 60 g of sodium hydroxide was dissolved in 1 L of deionized water while holding the solution at 25° C. Then, the resultant substance was matured at 98° C. for 24 hours. After cooling, a precipitate was washed with deionized water until the electric conductivity of a filtrate reached 100 μS/cm or less to give a slurry with a 5% by mass concentration. The slurry was dried under stirring by performing spraying at a drying temperature of 180° C., at a spraying pressure of 0.16 MPa, and at a spraying velocity of about 150 mL/min with a spray drier (DL-41, manufactured by YAMATO SCIENTIFIC CO., LTD.) to give hydrotalcite compound fine particles H-1.

From results of thermogravimetric analysis, X-ray Fluorescence Analysis, and CHN elemental analysis, the composition was determined as follows. Table 2 shows the physical properties of the hydrotalcite compound fine particles H-2.

$$Mg^{2+}_{0.692}Al^{3+}_{0.308}(OH)^{-}_{2.000}.0.154CO_3^{2-}.0.538H_2O$$

Production Example 2 of Hydrotalcite Compound Fine Particles

Hydrotalcite compound fine particles H-2 were obtained in the same manner as in Production Example 1, except changing the magnesium chloride hexahydrate to 246.5 g of magnesium sulfate heptahydrate, changing the aluminum chloride hexahydrate to 126.1 g of aluminum sulfate hexadecahydrate, and adjusting the pH with liquid in which 53 g of sodium carbonate in addition to 60 g of sodium hydroxide were dissolved. From results of thermogravimetric analysis, X-ray Fluorescence Analysis, and CHN elemental analysis, the composition was determined as follows. Table 2 shows the physical properties of the hydrotalcite compound fine particles H-2.

$$Mg^{2+}_{0.692}Al^{3+}_{0.308}(OH)^{-}_{2.000}.0.150CO_3^{2-}.0.555H_2O$$

Production Example 3 of Hydrotalcite Compound Fine Particles

Hydrotalcite compound fine particles H-3 were obtained in the same manner as in Production Example 1, except changing the magnesium chloride hexahydrate to 256.4 g of magnesium nitrate hexahydrate, changing the aluminum chloride hexahydrate to 150.1 g of aluminum nitrate nonahydrate, and adjusting the pH with liquid in which 53 g of sodium carbonate in addition to 60 g of sodium hydroxide were dissolved. From results of thermogravimetric analysis, X-ray Fluorescence Analysis, and CHN elemental analysis, the composition was determined as follows. Table 2 shows the physical properties of the hydrotalcite compound fine particles H-3.

$$Mg^{2+}_{0.692}Al^{13+}_{0.308}(OH)^{-}_{2.000}.0.141CO_3^{2-}.0.502H_2O$$

Production Example 4 of Hydrotalcite Compound Fine Particles

Hydrotalcite compound fine particles H-4 were obtained in the same manner as in Production Example 1, except adjusting the pH with liquid in which 53 g of sodium carbonate in addition to 60 g of sodium hydroxide were dissolved and changing the spraying conditions of the spray drier so that the spraying pressure was 0.12 MPa and the spraying velocity was about 110 mL/min From results of thermogravimetric analysis, X-ray Fluorescence Analysis, and CHN elemental analysis, the composition was determined as follows. Table 2 shows the physical properties of the hydrotalcite compound fine particles H-4.

$$Mg^{2+}_{0.692}Al^{3+}_{0.308}(OH)^{-}_{2.000}.0.155CO_3^{2-}.0.544H_2O$$

Production Example 5 of Hydrotalcite Compound Fine Particles

Hydrotalcite compound fine particles H-5 were obtained in the same manner as in Production Example 2, except changing the amount of the aluminum sulfate hexadecahydrate to 105.1 g and changing the spraying conditions of the spray drier so that the spraying pressure was 0.10 MPa and the spraying velocity was about 70 mL/min. From results of thermogravimetric analysis, X-ray Fluorescence Analysis, and CHN elemental analysis, the composition was determined as follows. Table 2 shows the physical properties of the hydrotalcite compound fine particles H-5.

$$Mg^{2+}_{0.750}Al^{3+}_{0.250}(OH)^{-}_{2.000}.0.125CO_3^{2-}.0.510H_2O$$

Production Example 6 of Hydrotalcite Compound Fine Particles

The amount of the aluminum chloride nonahydrate was changed to 80.5 g and the pH was adjusted with liquid in which 53 g of sodium carbonate in addition to 60 g of sodium hydroxide were dissolved. Hydrotalcite compound fine particles H-6 were obtained in the same manner as in Production Example 1, except changing the spraying conditions of the spray drier so that the spraying pressure was 0.10 MPa and the spraying velocity was about 60 mL/min. From results of thermogravimetric analysis, X-ray Fluorescence Analysis, and CHN elemental analysis, the composition was determined as follows. Table 2 shows the physical properties of the hydrotalcite compound fine particles H-6.

$$Mg^{2+}_{0.750}Al^{3+}_{0.250}(OH)^{-}_{2.000}.0.125CO_3^{2-}.0.490H_2O$$

Production Example 7 of Hydrotalcite Compound Fine Particles

The hydrotalcite compound fine particles H-2 were classified to obtain hydrotalcite compound fine particles H-7. Table 2 shows the physical properties of the hydrotalcite compound fine particles H-7.

Production Example 8 of Hydrotalcite Compound Fine Particles

Hydrotalcite compound fine particles H-8 were similarly obtained, except changing the spraying conditions of the spray drier so that the spraying pressure was 0.08 MPa and the spray velocity was about 40 mL/min in the production of the hydrotalcite compound fine particles H-6. From results of thermogravimetric analysis, X-ray Fluorescence Analysis, and CHN elemental analysis, the composition was determined as follows. Table 2 shows the physical properties of the hydrotalcite compound fine particles H-8.

$$Mg^{2+}_{0.750}Al^{3+}_{0.250}(OH)^{-}_{2.000}.0.120CO_3^{2-}0.500H_2O$$

Production Example 9 of Hydrotalcite Compound Fine Particles

The hydrotalcite compound fine particles H-5 were classified to obtain hydrotalcite compound fine particles H-9. Table 2 shows the physical properties of the hydrotalcite compound fine particles H-9.

TABLE 2

| Hydrotalcite compound fine particles | |
|---|---|
| No. | Number average particle diameter of primary particles (nm) |
| H-1 | 450 |
| H-2 | 100 |
| H-3 | 630 |
| H-4 | 1750 |
| H-5 | 3500 |
| H-6 | 3600 |
| H-7 | 70 |

TABLE 2-continued

| Hydrotalcite compound fine particles | |
|---|---|
| No. | Number average particle diameter of primary particles (nm) |
| H-8 | 4500 |
| H-9 | 3400 |

Production Example 1 of Silica Fine Particles

In a reactor with a stirrer, untreated dry silica with a number average particle diameter of primary particles of 18 nm was charged, and then the reactor was heated to 200° C. in a fluidized state by stirring.

The inside of the reactor was replaced with nitrogen gas to seal the reactor, 25% by mass dimethyl silicone oil (Viscosity=100 $mm^2$/second) based on 100% by mass dry silica was sprayed, and then stirring was continued for 30 minutes. Then, the temperature was increased to 300° C. under stirring, the resultant substance was further stirred for 2 hours, the resultant substance was taken out, and then crushing treatment was carried out, so that silica fine particles 1 were obtained. The hydrophobicity of the silica fine particles 1 was 94 (% by volume).

Production Example of Resin Fine Particle Dispersion 1 (an Aqueous Dispersion of Resin Fine Particle)

Polyester 60.0 Parts by Mass

[Composition (Molar ratio)/Polyoxypropylene (2.2)-2,2-bis(4-hydroxyphenyl)propane:Ethylene glycol:Terephthalic acid:Maleic acid:Trimellitic acid=35:15:33:15:2, Mn: 4,600, Mw: 16,500, Peak molecular weight (Mp): 10,400, Mw/Mn: 3.6, Acid value: 13 mgKOH/g]

Anionic surfactant (manufactured by Daiichi Kogyo Seiyaku Co., Ltd.: NEOGEN RK) 0.3 part by mass N,N-dimethylamino ethanol 1.5 parts by mass Tetrahydrofuran 200.0 parts by mass The materials above were mixed and dissolved, and then stirred at 66.6 $s^{-1}$ using an ultrahigh speed stirring device T.K. Robomix (manufactured by PRIMIX Corporation). Furthermore, 180 parts by mass ion exchanged water was added dropwise, so that a resin fine particle dispersion 1 was obtained.

The median size on a volume basis of the resin fine particles measured using a laser diffraction/scattering type particle size distribution meter (manufactured by Horiba, Ltd.: LA-950) was 0.18 μm and the 95% particle diameter was 0.25 μm.

Production Example 2 of Resin Fine Particle Dispersion

Styrene: 320 parts by mass n-butyl acrylate: 80 parts by mass

Acrylic acid: 10 parts by mass

Dodecane thiol: 10 parts by mass 420 parts by mass of a solution in which the materials above were mixed, 6 parts by mass of a nonionic surfactant (manufactured by Sanyo Chemical Industries, Ltd., Nonipol 400), and 10 parts by mass of an anionic surfactant (manufactured by Daiichi Pharmaceutical Co., Ltd., NEOGEN R) were dissolved in 550 parts by mass of ion exchanged water was placed in a flask, and then dispersed and emulsified. 50 parts by mass of ion exchanged water in which 4 parts by mass of ammonium persulfate was dissolved was charged under slow stirring and mixing for 10 minutes. Thereafter, the inside of the flask is sufficiently replaced with nitrogen, and then heated under stirring until the inside of the system reached 70° C. in an oil bath. Then, emulsion polymerization was continued as it was for 5 hours, so that resin fine particle dispersion liquid 2 was obtained.

The volume average particle diameter (D50) of latex in the resin fine particle dispersion liquid 2 was 155 nm as measured with a laser diffraction particle size distribution meter (manufactured by Horiba, Ltd., LA-700). The glass transition point of the resin was 54° C. as measured at a heating rate of 10° C./min using a differential scanning calorimeter (manufactured by Shimadzu Corporation, DSC-50). The weight average molecular weight (in terms of polystyrene) was 33000 as measured by using a THF as a solvent using a molecular weight measurement instrument (manufactured by TOSOH CORP., HLC-8020).

Production Example of Colorant Fine Particle Dispersion

Cyan pigment 100.0 parts by mass
(Pigment Blue 15:3, manufactured by Dainichiseika Color & Chemicals Mfg. Co., Ltd.)
Anionic surfactant (manufactured by Daiichi Kogyo Seiyaku Co., Ltd.: NEOGEN RK) 15.0 parts by mass
Ion exchanged water 885.0 parts by mass The materials above were mixed and dissolved, and then dispersed for about 1 hour using a high pressure impact type dispersing machine Nanomizer (manufactured by Yoshida kikai co., ltd.). Then, a colorant was dispersed to prepare a colorant fine particle dispersion (Solid content concentration of 10% by mass). The median size on a volume basis of the colorant fine particles was 0.2 μm.

Production Example of Wax Fine Particle Dispersion

Ester wax (Behenic acid behenyl, Melting point of 75° C.) 100.0 parts by mass
Anionic surfactant (manufactured by Daiichi Kogyo Seiyaku Co., Ltd.: NEOGEN RK) 10.0 parts by mass
Ion exchanged water 880.0 parts by mass The materials above were charged into a container with a stirring device, heated to 90° C., stirred with a shearing stirring portion having a rotor outer diameter of 3 cm and a clearance of 0.3 mm under the conditions of a number of rotations of the rotor of 310 $s^{-1}$ and a number of rotations of a screen of 310 $s^{-1}$ using a CLEARMIX W-MOTION (manufactured by M Technique Co., Ltd.) while circulating, and then subjected to dispersion treatment for 60 minutes. Thereafter, the resultant substance was cooled to 40° C. under cooling treatment conditions of a number of rotations of the rotor of 33.3 $s^{-1}$, a number of rotations of the screen of 33.3 $s^{-1}$, and a cooling rate of 10° C./min, whereby a wax fine particle dispersion (Solid content concentration of 10% by mass) was obtained. The median size on a volume basis of the wax fine particles was 0.15 μm.

Production Example 1 of Toner Particles

Resin fine particle dispersion 1 40.0 parts by mass
Colorant fine particle dispersion 10.0 parts by mass
Wax fine particle dispersion 20.0 parts by mass
1% by mass calcium chloride aqueous solution 20.0 parts by mass
Ion exchanged water 110.0 parts by mass The materials above were mixed and dispersed using a homogenizer (manufactured by IKA: ULTRA-TURRAX T50), and then heated to 45° C. in a water bath under stirring with a stirring blade. When observed under an optical microscope after held at 45° C. for 1 hour, it was confirmed that the aggregated particles having a weight average particle diameter (D4) of 5.5 μm were formed (Aggregation process).

40.0 parts by mass of 5% by mass trisodium citrate aqueous solution was added, and then the temperature was increased to 85° C. while continuing stirring and held at the temperature for 120 minutes, so that an aqueous dispersion containing united core particles was obtained (Primary fusion process). When the particle diameter of the core particles was measured, the weight average particle diameter (D4) was 5.8 μm.

Subsequently, water was placed in the water bath while continuing the stirring to cool the aqueous dispersion of the core particles to 25° C.

Subsequently, 12.1 parts by mass of the resin fine particle dispersion 2 was added. Thereafter, stirring was performed for 10 minutes, 60.0 parts by mass of 2% by mass calcium chloride aqueous solution was further added dropwise, and then the temperature was increased to 35° C. A small amount of the obtained mixed liquid was extracted whenever necessary in this state, and then allowed to pass through a 2 μm microfilter. Then it was confirmed whether the filtrate was transparent. When the filtrate was not transparent, the stirring of the mixed liquid was continued.

After confirming that the filtrate became transparent, the resin fine particles adhered to core particles, and a shell adhesion body was formed, the temperature of the aqueous dispersion of the shell adhesion body was increased to 40° C., and then stirring was performed for 1 hour. Thereafter, 35.0 parts by mass of 5% by mass trisodium citrate aqueous solution was added, the temperature was increased to 65° C., and then stirring was performed for 3.0 hours (Secondary fusion process).

Thereafter, the obtained liquid was cooled to 25° C., and then filtered and subjected to solid-liquid separation. Thereafter, 800 parts by mass of ion exchanged water based on the solid content was added, and then stirring and cleaning were performed for 30 minutes. Thereafter, filtration and solid-liquid separation were performed again.

The filtration and the cleaning were repeated until the electrical conductivity of the filtrate was 150 μS/cm or less as described above in order to eliminate influence of residual surfactants.

Next, the obtained solid content was dried to give toner particles 1. The weight average particle diameter (D4) of the toner particles 1 was 7.0 μm. Table 3 shows the physical properties of the obtained toner particles 1.

Production Example 2 of Toner Particles

Resin fine particle dispersion 1 40.0 parts by mass
Colorant fine particle dispersion 10.0 parts by mass
Wax fine particle dispersion 15.0 parts by mass
1% by mass calcium chloride aqueous solution 30.0 parts by mass
Ion exchanged water 110.0 parts by mass The materials above were mixed and dispersed using a homogenizer (manufactured by IKA: ULTRA-TURRAX T50), and then heated to 45° C. in a water bath under stirring with a stirring blade. When observed under an optical microscope after held at 45° C. for 1 hour, it was confirmed that the aggregated particles having a weight average particle diameter (D4) of 2.5 μm were formed (Aggregation process).

40.0 parts by mass of 5% by mass trisodium citrate aqueous solution was added, and then the temperature was increased to 85° C. while continuing stirring and held at the temperature for 120 minutes, so that an aqueous dispersion containing united core particles was obtained (Primary fusion process). When the particle diameter of the core particles was measured, the weight average particle diameter (D4) was 2.9 μm.

The subsequent processes were performed in the same manner as in Production Example 1, whereby toner particles 2 having a weight average particle diameter (D4) of 3.0 μm were obtained.

Production Example 3 of Toner Particles

Resin fine particle dispersion 1 40.0 parts by mass
Colorant fine particle dispersion 10.0 parts by mass
Wax fine particle dispersion 20.0 parts by mass
1% by mass calcium chloride aqueous solution 10.0 parts by mass
Ion exchanged water 110.0 parts by mass The materials above were mixed and dispersed using a homogenizer (manufactured by IKA: ULTRA-TURRAX T50), and then heated to 55° C. in a water bath under stirring with a stirring blade. When observed under an optical microscope after held at 55° C. for 1 hour, it was confirmed that the aggregated particles having a weight average particle diameter (D4) of 9.2 μm were formed (Aggregation process).

40.0 parts by mass of 5% by mass trisodium citrate aqueous solution was added, and then the temperature was increased to 85° C. while continuing stirring and held at the temperature for 120 minutes, so that an aqueous dispersion containing united core particles was obtained (Primary fusion process). When the particle diameter of the core particles was measured, the weight average particle diameter (D4) was 9.5 μm.

The subsequent processes were performed in the same manner as in Production Example 1, whereby toner particles 3 having a weight average particle diameter (D4) of 10.0 μm were obtained.

Production Example 4 of Toner Particles

Cyan pigment 6 parts by mass
(Pigment Blue 15:3, manufactured by Dainichiseika Color & Chemicals Mfg. Co., Ltd.)
Styrene-butyl acrylate-butyl maleate half ester copolymer (Glass transition point Tg=63° C.) 100 parts by mass
Iron complex of monoazo dye (Negatively-charged control agent) 2 parts by mass
Low molecular weight polyethylene
(DSC endothermic peak of 106.7° C., Mw/Mn=1.08) 4 parts by mass The materials were mixed with a blender, and then melted and kneaded with a biaxial extruder heated to 110° C. Then, a cooled kneaded substance was roughly pulverized with a hammer mill, and then the roughly pulverized substances were finely pulverized with a mechanical pulverizer. The obtained finely pulverized substances were classified with a multi-division classifier using the Coanda effect to give toner particles 4. The weight average particle diameter (D4) of the toner particles 4 was 6.9 μm.

Production Example 5 of Toner Particles 710 parts by mass of ion exchanged water and 850% by mass of 0.1 mol/L $Na_3PO_4$ aqueous solution were added into a four-necked container, and then held at 60° C. under stirring at 2,000 $S^{-1}$ using a high-speed stirring device T.K. homomixer (manufactured by Tokushu Kika Kogyo Co., Ltd.). 68 parts by mass of 1.0 mol/L $CaCl_2$ aqueous solution was gradually added thereto to prepare a fine aqueous dispersion medium containing a dispersion stabilizer.

Styrene 124 parts by mass
n-butyl acrylate 36 parts by mass
Copper phthalocyanine pigment (Pigment blue 15:3) 13 parts by mass
Polyester 10 parts by mass
(Terephthalic acid-propylene oxide-modified bisphenol A (2 mol adduct) copolymer, Acid value: 10 mgKOH/g, Glass transition temperature (Tg): 70° C., Weight average molecular weight (Mw): 10500)
Charge control agent (BONTRON E88: manufactured by Orient Chemical Industries Co., Ltd.) 2 parts by mass
Fischer-Tropsch wax (Melting point: 78° C.) 15 parts by mass The materials above were stirred for 3 hours using an Attritor (manufactured by NIPPON COKE &. ENGINEERING CO., LTD.), and then the components were dispersed in polymerizable monomers to prepare a monomer mixture.

To the monomer mixture, 20.0 parts by mass of 1,1,3,3-tetramethylbutyl peroxy 2-ethylhexanoate (50% toluene solution) which is a polymerization initiator was added to prepare a polymerizable monomer composition.

The polymerizable monomer composition was charged into an aqueous dispersion medium, and then granulated for 5 minutes while maintaining the number of rotations of the stirrer at 150 $s^{-1}$. Thereafter, the high-speed stirring device was changed to a propeller stirrer, the internal temperature was increased to 70° C., and then a reaction was performed for 6 hours under slow stirring.

Subsequently, the temperature inside the container was increased to a temperature of 80° C. and held at 80° C. for 4 hours, and then cooled, so that a slurry was obtained. Into the container containing the slurry, dilute hydrochloric acid was added to remove the dispersion stabilizer. Furthermore, separation by filtration, cleaning, and drying were performed, so that toner particles 5 were obtained. The weight average particle diameter (D4) of the obtained toner particles 5 was 7.1 μm.

Production Example 6 of Toner Particles

Toner particles 6 were similarly produced, except changing the resin fine particle dispersion 1 to the resin fine particle dispersion 2 in Production Example 1. The weight average particle diameter (D4) of the toner particles 6 was 7.2 μm. Table 3 shows the physical properties of the obtained toner particles 6.

Production Example 1 of Toner

To the obtained toner particles 1 (100 parts by mass), the titanate fine particles T1 (0.5 part by mass), the hydrotalcite compound fine particles H-1 (0.3 part by mass), and the silica fine particles 1 (0.2 part by mass) were externally added and mixed by FM10C (manufactured by NIPPON COKE &. ENGINEERING CO., LTD.). The external addition was performed under the following conditions of a charged amount of the toner particles: 2.0 kg, a number of rotations: 66.6 $s^{-1}$, an external addition time: 10 minutes, and cooling water of a temperature of 22° C. and a flow rate of 11 L/min.

Thereafter, the mixture was sieved through a mesh having an opening of 200 μm to give a toner 1. Table 3 shows external addition conditions of the toner 1. Table 4 shows the toner physical properties of the toner 1.

Production Examples 1 to 24 of Toners and Production Examples 1 to 4 of Comparative Toners Toners 2 to 24 and comparative toners 1 to 4 were similarly obtained, except changing the type and the addition amount of the toner particles, the titanate fine particles, the hydrotalcite compound fine particles, and the silica fine particles to be used and external addition treatment methods as shown in Table 4. Table 3 shows external addition conditions of the toners 2 to 24 and the comparative toners 1 to 4. Table 4 shows the toner physical properties of the toners 2 to 24 and the comparative toners 1 to 4.

TABLE 3

| | Toner particles | | | | | | | | External addition treatment | External addition treatment method |
|---|---|---|---|---|---|---|---|---|---|---|
| Toner No. | No. | Weight average particle diameter (D4)/μm | Shape factor SF-2 | Titanate fine particles (Type/Amount) (parts by mass) | | Hydrotalcite compound fine particles (Type/Amount) (parts by mass) | | Silica fine particle amount (parts by mass) | method FM mixer Treatment conditions (FM10C) | FM mixer Article temperature/ Cooling water condition |
| Toner 1 | Toner particles 1 | 7.0 | 119 | T-1 | 0.5 | H-1 | 0.3 | 0.2 | 66.6 $s^{-1}$ × 10 min | 22° C. 11 L/min |
| Toner 2 | Toner particles 1 | 7.0 | 119 | T-2 | 0.7 | H-1 | 0.3 | 0.2 | 66.6 $s^{-1}$ × 10 min | 22° C. 11 L/min |
| Toner 3 | Toner particles 1 | 7.0 | 119 | T-3 | 1.0 | H-1 | 0.3 | 0.2 | 66.6 $s^{-1}$ × 10 min | 22° C. 11 L/min |
| Toner 4 | Toner particles 1 | 7.0 | 119 | T-4 | 1.1 | H-1 | 0.3 | 0.2 | 66.6 $s^{-1}$ × 10 min | 40° C. 11 L/min |
| Toner 5 | Toner particles 1 | 7.0 | 119 | T-5 | 0.1 | H-1 | 0.3 | 0.2 | 66.6 $s^{-1}$ × 10 min | 22° C. 11 L/min |
| Toner 6 | Toner particles 1 | 7.0 | 119 | T-1 | 0.5 | H-2 | 0.1 | 0.2 | 66.6 $s^{-1}$ × 10 min | 22° C. 11 L/min |
| Toner 7 | Toner particles 1 | 7.0 | 119 | T-1 | 0.5 | H-3 | 0.4 | 0.2 | 66.6 $s^{-1}$ × 10 min | 22° C. 11 L/min |
| Toner 8 | Toner particles 1 | 7.0 | 119 | T-1 | 0.5 | H-4 | 2.0 | 0.2 | 66.6 $s^{-1}$ × 10 min | 22° C. 11 L/min |
| Toner 9 | Toner particles 1 | 7.0 | 119 | T-1 | 0.5 | H-5 | 3.0 | 0.2 | 66.6 $s^{-1}$ × 10 min | 22° C. 11 L/min |
| Toner 10 | Toner particles 1 | 7.0 | 119 | T-1 | 0.03 | H-1 | 0.3 | 0.2 | 66.6 $s^{-1}$ × 10 min | 22° C. 11 L/min |
| Toner 11 | Toner particles 1 | 7.0 | 119 | T-1 | 0.08 | H-1 | 0.3 | 0.2 | 66.6 $s^{-1}$ × 10 min | 22° C. 11 L/min |
| Toner 12 | Toner particles 1 | 7.0 | 119 | T-1 | 1.1 | H-1 | 0.3 | 0.2 | 66.6 $s^{-1}$ × 10 min | 22° C. 11 L/min |
| Toner 13 | Toner particles 1 | 7.0 | 119 | T-1 | 1.9 | H-1 | 0.3 | 0.2 | 66.6 $s^{-1}$ × 10 min | 22° C. 11 L/min |
| Toner 14 | Toner particles 1 | 7.0 | 119 | T-1 | 0.5 | H-1 | 0.3 | 0.2 | 33.3 $s^{-1}$ × 10 min | 22° C. 11 L/min |
| Toner 15 | Toner particles 1 | 7.0 | 119 | T-4 | 1.1 | H-1 | 0.3 | 0.2 | 66.6 $s^{-1}$ × 10 min | 22° C. 11 L/min |
| Toner 16 | Toner particles 1 | 7.0 | 119 | T-4 | 1.1 | H-1 | 0.3 | 0.2 | 33.3 $s^{-1}$ × 10 min | 22° C. 11 L/min |
| Toner 17 | Toner particles 1 | 7.0 | 119 | T-1 | 0.5 | H-1 | 0.3 | 0.2 | 66.6 $s^{-1}$ × 10 min | 40° C. 11 L/min |
| Toner 18 | Toner particles 1 | 7.0 | 119 | T-1 | 0.5 | H-9 | 3.0 | 0.2 | 66.6 $s^{-1}$ × 10 min | 50° C. 11 L/min |
| Toner 19 | Toner particles 6 | 7.2 | 125 | T-1 | 0.5 | H-1 | 0.3 | 0.2 | 66.6 $s^{-1}$ × 10 min | 22° C. 11 L/min |
| Toner 20 | Toner particles 5 | 7.1 | 104 | T-1 | 0.4 | H-1 | 0.3 | 0.2 | 66.6 $s^{-1}$ × 10 min | 22° C. 11 L/min |
| Toner 21 | Toner particles 4 | 6.9 | 138 | T-1 | 0.8 | H-1 | 0.3 | 0.2 | 66.6 $s^{-1}$ × 10 min | 22° C. 11 L/min |
| Toner 22 | Toner particles 2 | 3.0 | 119 | T-1 | 1.3 | H-1 | 0.3 | 0.5 | 66.6 $s^{-1}$ × 10 min | 22° C. 11 L/min |
| Toner 23 | Toner particles 3 | 10.0 | 119 | T-1 | 0.3 | H-1 | 0.3 | 0.2 | 66.6 $s^{-1}$ × 10 min | 22° C. 11 L/min |
| Toner 24 | Toner particles 1 | 7.0 | 119 | T-7 | 0.5 | H-1 | 0.3 | 0.2 | 66.6 $s^{-1}$ × 10 min | 22° C. 11 L/min |
| Comparative toner 1 | Toner particles 1 | 7.0 | 119 | T-6 | 1.4 | H-1 | 0.3 | 0.2 | 66.6 $s^{-1}$ × 10 min | 22° C. 11 L/min |
| Comparative toner 2 | Toner particles 1 | 7.0 | 119 | T-1 | 0.5 | H-6 | 3.0 | 0.2 | 66.6 $s^{-1}$ × 10 min | 22° C. 11 L/min |
| Comparative toner 3 | Toner particles 1 | 7.0 | 119 | T-1 | 0.5 | H-7 | 0.08 | 0.2 | 66.6 $s^{-1}$ × 10 min | 22° C. 11 L/min |
| Comparative toner 4 | Toner particles 4 | 6.9 | 138 | T-6 | 4.0 | H-8 | 0.3 | 1.2 | 66.6 $s^{-1}$ × 10 min | 22° C. 11 L/min |

TABLE 4

| Toner No. | Titanate fine particles: Number average diameter of primary particles on toner surface (nm) | Coverage (%) | Fixing ratio (%) | Number of particles per 0.5 πμm² | Coefficient of variation of number of particles | Hydrotalcite compound fine particles: Number average diameter of primary particles on toner surface (nm) | Fixing ratio (%) | Aspect ratio | Primary particles/Secondary particles | FT-4 total energy (mJ) |
|---|---|---|---|---|---|---|---|---|---|---|
| Toner 1 | 35 | 5.0 | 95 | 30 | 0.2 | 449 | 50 | 3.0 | 5.0 | 180 |
| Toner 2 | 51 | 4.8 | 90 | 23 | 0.2 | 449 | 48 | 2.9 | 4.8 | 220 |
| Toner 3 | 71 | 5.1 | 90 | 17 | 0.2 | 448 | 49 | 3.0 | 5.1 | 280 |
| Toner 4 | 80 | 5.0 | 89 | 14 | 0.3 | 449 | 52 | 2.8 | 5.0 | 302 |
| Toner 5 | 11 | 5.1 | 98 | 36 | 0.2 | 450 | 50 | 3.0 | 4.9 | 178 |
| Toner 6 | 35 | 4.8 | 97 | 31 | 0.3 | 99 | 59 | 2.9 | 4.8 | 175 |
| Toner 7 | 35 | 5.1 | 96 | 29 | 0.2 | 628 | 42 | 2.5 | 5.1 | 230 |
| Toner 8 | 36 | 5.0 | 95 | 30 | 0.3 | 1745 | 21 | 3.0 | 3.5 | 320 |
| Toner 9 | 36 | 5.1 | 94 | 32 | 0.3 | 3495 | 18 | 1.8 | 2.1 | 400 |
| Toner 10 | 35 | 0.3 | 97 | 2 | 0.3 | 449 | 52 | 2.9 | 5.0 | 240 |
| Toner 11 | 36 | 0.5 | 96 | 6 | 0.2 | 449 | 51 | 2.8 | 4.8 | 220 |
| Toner 12 | 36 | 10.0 | 95 | 58 | 0.3 | 449 | 50 | 3.0 | 5.1 | 175 |
| Toner 13 | 35 | 20.0 | 94 | 126 | 0.3 | 448 | 49 | 2.8 | 5.0 | 170 |
| Toner 14 | 37 | 5.0 | 75 | 31 | 0.3 | 448 | 35 | 3.0 | 5.0 | 190 |
| Toner 15 | 80 | 5.1 | 58 | 15 | 0.3 | 449 | 48 | 3.0 | 4.9 | 178 |
| Toner 16 | 80 | 5.3 | 88 | 16 | 0.6 | 449 | 49 | 2.9 | 5.1 | 260 |
| Toner 17 | 34 | 5.1 | 98 | 29 | 0.3 | 450 | 63 | 2.9 | 5.1 | 280 |
| Toner 18 | 35 | 5.1 | 95 | 28 | 0.3 | 3398 | 47 | 1.4 | 4.8 | 190 |
| Toner 19 | 36 | 5.1 | 94 | 29 | 0.2 | 445 | 50 | 3.0 | 4.8 | 200 |
| Toner 20 | 36 | 5.0 | 94 | 23 | 0.2 | 448 | 48 | 2.9 | 5.1 | 185 |
| Toner 21 | 35 | 5.0 | 88 | 42 | 0.4 | 449 | 48 | 2.7 | 5.0 | 270 |
| Toner 22 | 36 | 5.1 | 96 | 70 | 0.3 | 450 | 49 | 2.8 | 5.1 | 240 |
| Toner 23 | 35 | 4.9 | 94 | 22 | 0.2 | 451 | 51 | 2.9 | 5.0 | 220 |
| Toner 24 | 36 | 5.1 | 89 | 29 | 0.3 | 452 | 50 | 3.0 | 4.8 | 190 |
| Comparative toner 1 | 85 | 5.0 | 45 | 10 | 0.3 | 452 | 48 | 2.9 | 5.1 | 353 |
| Comparative toner 2 | 34 | 4.9 | 90 | 30 | 0.3 | 3595 | 12 | 2.2 | 2.5 | 402 |
| Comparative toner 3 | 35 | 5.0 | 92 | 31 | 0.3 | 69 | 85 | 1.4 | 7.2 | 352 |
| Comparative toner 4 | 85 | 6.8 | 62 | 38 | 0.4 | 4490 | 10 | 1.3 | 2.0 | 320 |

Example 1

The following evaluation was performed for the toner 1. Table 5 shows the evaluation results.

In the evaluation, a converted machine of LBP7700C (manufactured by CANON KABUSHIKI KAISHA) was used as an evaluation machine. The process speed of LBP7700C was converted to 370 mm/sec and the diameter of a toner carrier was changed to 10 mm supposing a size reduction of a cartridge. Then, adjustments required for enabling image formation under the conditions were performed. A toner was removed from a cyan cartridge, and then the toner 1 was charged in place of the removed toner.

Evaluation of Fogging

The fogging was evaluated in a low temperature and low humidity environment (15° C./10% RH). As evaluation paper, XEROX4200 paper (manufactured by XEROX, 75 g/m²) was used.

Supposing a severe long term durability test to the toner in a low temperature and low humidity environment, 20000 sheets were subjected to an intermittent durability test of outputting two sheets with a horizontal line pattern image having a 5% printing rate every 5 seconds.

Thereafter, a solid white image was output. Then, the white background portion reflection density worst value was defined as Ds and the average reflection density of a transfer material before image formation was defined as Dr, and then a Dr-Ds was defined as a fogging value.

For the measurement of the white background portion reflection density, a reflection density meter (Reflect meter model TC-6DS, manufactured by Tokyo Denshoku. Co., Ltd.) was used and an amberlite filter was used for a filter.

A smaller value indicates a better fogging level. The evaluation criteria are as follows.

Evaluation Criteria

A: Less than 0.5%

B: 0.5% or more and less than 1.5%

C: 1.5% or more and less than 3.0%

D: 3.0% or more

Evaluation of Streak Image

A streak image is an image defect which is an about 0.5 mm vertical streak generated by member contamination caused by external additives and which is likely to be observed when an entire surface halftone image is output.

For an evaluation of the streak image, a 20,000 sheet durability test was performed in the same environment as that of the fogging evaluation, an entire surface halftone image was output every 1,000 sheets on and after 5,000 sheets, and then the presence or absence of streaks was observed.

Evaluation Criteria

A: No streaks were generated even after 20,000 sheets were output.

B: Streaks were generated after 15,000 to 20,000 sheets were output.

C: Streaks were generated after 10,000 to 14,000 sheets were output.

D: Streaks were generated after 5,000 to 9,000 sheets were output.

Evaluation of Fogging in Restarting after Stop of Apparatus for Several Days after Continuous Use The fogging was evaluated in a high temperature and high humidity environment (30° C./80% RH). As evaluation paper, XEROX4200 paper (manufactured by XEROX, 75 g/m$^2$) was used.

Supposing a severe long term durability test to the toner in a high temperature and high humidity environment, 20000 sheets were subjected to an intermittent durability test of outputting two sheets with a horizontal line pattern image having a 5% printing rate every 5 seconds. Thereafter, the power supply of the evaluation machine was stopped, and then the evaluation machine was allowed to stand in the high temperature and high humidity environment for 72 hours. After allowed to stand, the main body was restarted, and then a fogging evaluation was carried out by the same method described above.

Evaluation Criteria

A: Less than 0.5%

B: 0.5% or more and less than 1.5%

C: 1.5% or more and less than 3.0%

D: 3.0% or more

TABLE 5

| | Toner No. | Fogging evaluation in low temperature and low humidity environment | | Fogging evaluation after long-term use + left in high temperature and high humidity environment | | Evaluation of number of sheets at the time when streaks were generated in low temperature and low humidity environment | |
|---|---|---|---|---|---|---|---|
| Ex. 1 | Toner 1 | A | 0.2 | A | 0.2 | A | Not occur |
| Ex. 2 | Toner 2 | A | 0.3 | A | 0.3 | A | Not occur |
| Ex. 3 | Toner 3 | B | 1 | A | 0.4 | A | Not occur |
| Ex. 4 | Toner 4 | C | 1.5 | A | 0.4 | B | 16000 |
| Ex. 5 | Toner 5 | A | 0.2 | A | 0.3 | A | Not occur |
| Ex. 6 | Toner 6 | A | 0.2 | A | 0.3 | A | Not occur |
| Ex. 7 | Toner 7 | A | 0.2 | A | 0.4 | A | Not occur |
| Ex. 8 | Toner 8 | B | 1.2 | A | 0.4 | A | Not occur |
| Ex. 9 | Toner 9 | B | 1.2 | B | 0.9 | B | 19000 |
| Ex. 10 | Toner 10 | B | 1.2 | B | 0.9 | A | Not occur |
| Ex. 11 | Toner 11 | A | 0.2 | A | 0.4 | A | Not occur |
| Ex. 12 | Toner 12 | A | 0.2 | A | 0.2 | A | Not occur |
| Ex. 13 | Toner 13 | A | 0.4 | B | 0.7 | A | Not occur |
| Ex. 14 | Toner 14 | B | 0.5 | B | 0.6 | B | 18000 |
| Ex. 15 | Toner 15 | A | 0.3 | B | 0.7 | A | Not occur |
| Ex. 16 | Toner 16 | B | 1.2 | B | 0.5 | A | Not occur |
| Ex. 17 | Toner 17 | B | 0.5 | B | 0.7 | A | Not occur |
| Ex. 18 | Toner 18 | B | 1.4 | C | 1.7 | B | 16000 |
| Ex. 19 | Toner 19 | A | 0.2 | B | 0.6 | A | Not occur |
| Ex. 20 | Toner 20 | A | 0.3 | B | 0.6 | A | Not occur |
| Ex. 21 | Toner 21 | A | 0.4 | B | 0.6 | B | 17000 |
| Ex. 22 | Toner 22 | A | 0.4 | A | 0.2 | A | Not occur |
| Ex. 23 | Toner 23 | A | 0.2 | A | 0.4 | A | Not occur |
| Ex. 24 | Toner 24 | A | 0.4 | A | 0.4 | A | Not occur |
| Comp. Ex. 1 | Comparative toner 1 | D | 3.1 | C | 2.8 | D | 9000 |
| Comp. Ex. 2 | Comparative toner 2 | D | 3.8 | D | 4.0 | D | 8000 |
| Comp. Ex. 3 | Comparative toner 3 | D | 4.5 | D | 4.7 | C | 10000 |
| Comp. Ex. 4 | Comparative toner 4 | D | 3.8 | D | 4.2 | D | 6000 |

Examples 2 to 24 and Comparative Examples 1 to 4

The same evaluations as those of Example 1 were performed using the toners 2 to 24 and the comparative toners 1 to 4. Table 5 shows the evaluation results.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-166001 filed Aug. 30, 2017, which is hereby incorporated by reference herein in its entirety.

What is claimed is:

1. A toner comprising:

toner particles; and an external additive, wherein the external additive comprises titanate fine particles of which a Group II element is contained and hydrotalcite compound fine particles, when a number average particle diameter (D1) of primary particles of the titanate fine particles is defined as Lt (nm), the Lt (nm) is 10 nm or more and 80 nm or less, when a number average particle diameter (D1) of primary particles of the hydrotalcite compound fine particles is defined as Lh (nm), the Lh (nm) satisfies a following condition:

100≤Lh≤Weight average particle diameter (D4) of toner particles×0.50, and a surface coverage ratio by the titanate fine particles on the toner particles is 0.5% or more and 20.0% or less.

2. The toner according to claim 1, wherein a fixing ratio of the titanate fine particles to the toner particles is 60% or more and 100% or less.

3. The toner according to claim 1, wherein polyester is present on a surface of the toner particles.

4. The toner according to claim 1, wherein a shape factor SF-2 of the toner particles is 110 or more and 180 or less.

5. A toner comprising:

toner particles; and an external additive, wherein the external additive comprises titanate fine particles of which a Group II element is contained and hydrotalcite compound fine particles, when a number average particle diameter (D1) of primary particles of the titanate fine particles is defined as Lt (nm), the Lt (nm) is 10 nm or more and 80 nm or less, when a number average particle diameter (D1) of primary particles of the hydrotalcite compound fine particles is defined as Lh (nm), the Lh (nm) satisfies a following condition:

100 Lh Weight average particle diameter (D4) of toner particles×0.50, and 2 or more and 126 or less of the titanate fine particles are present per 0.5 $\pi\mu m^2$ of a surface of the toner.

6. The toner according to claim 5, wherein a coefficient of variation of a number of the titanate fine particles present per 0.5 $\pi\mu m^2$ of the surface of the toner is 0.5 or less.

7. A toner comprising:

toner particles; and an external additive, wherein the external additive comprises titanate fine particles of which a Group II element is contained and hydrotalcite compound fine particles, when a number average particle diameter (D1) of primary particles of the titanate fine particles is defined as Lt (nm), the Lt (nm) is 10 nm or more and 80 nm or less, when a number average particle diameter (D1) of primary particles of the hydrotalcite compound fine particles is defined as Lh (nm), the Lh (nm) satisfies a following condition:

100≤Lh≤Weight average particle diameter (D4) of toner particles×0.50, and a fixing ratio of the hydrotalcite compound fine particles to the toner particles is 20% or more and 60% or less.

8. A toner comprising:

toner particles; and an external additive, wherein the external additive comprises titanate fine particles of which a Group II element is contained and hydrotalcite compound fine particles, when a number average particle diameter (D1) of primary particles of the titanate fine particles is defined as Lt (nm), the Lt (nm) is 10 nm or more and 80 nm or less, when a number average particle diameter (D1) of primary particles of the hydrotalcite compound fine particles is defined as Lh (nm), the Lh (nm) satisfies a following condition:

100≤Lh≤Weight average particle diameter (D4) of toner particles×0.50, and an average aspect ratio of the hydrotalcite compound fine particles is 1.5 or more.

* * * * *